US007490884B2

(12) United States Patent
Matunaga et al.

(10) Patent No.: US 7,490,884 B2
(45) Date of Patent: Feb. 17, 2009

(54) ON-VEHICLE STRETCHER AND LITTER

(75) Inventors: Sigeyuki Matunaga, Gifu (JP); Noriyuki Matunaga, Gifu (JP); Kazuyuki Goto, Gifu (JP)

(73) Assignee: Matunaga Manufactory Co., Ltd. (JP)

( * ) Notice: Subject to any disclaimer, the term of this patent is extended or adjusted under 35 U.S.C. 154(b) by 0 days.

(21) Appl. No.: 11/821,732

(22) Filed: Jun. 25, 2007

(65) Prior Publication Data

US 2008/0001421 A1 Jan. 3, 2008

Related U.S. Application Data

(63) Continuation-in-part of application No. PCT/JP2005/014641, filed on Aug. 10, 2005.

(30) Foreign Application Priority Data

Dec. 24, 2004 (JP) ..... 2004-373729
Jun. 23, 2005 (JP) ..... 2005-183337

(51) Int. Cl.
*A61G 1/02* (2006.01)

(52) U.S. Cl. ..... 296/20; 5/611

(58) Field of Classification Search ..... 296/20, 296/19; 5/611, 625, 620, 626, 627
See application file for complete search history.

(56) References Cited

U.S. PATENT DOCUMENTS 4,767,148 A * 8/1988 Ferneau et al. ..... 296/20
4,921,295 A * 5/1990 Stollenwerk ..... 296/20
5,575,026 A * 11/1996 Way et al. ..... 5/611
6,276,010 B1 * 8/2001 Way et al. ..... 5/611
6,389,623 B1 * 5/2002 Flynn et al. ..... 296/20
6,735,794 B1 * 5/2004 Way et al. ..... 296/20
2004/0111798 A1 * 6/2004 Matunaga et al. ..... 5/625
2006/0082176 A1 * 4/2006 Broadley et al. ..... 296/20
2006/0225203 A1 * 10/2006 Hosoya et al. ..... 5/86.1
2007/0000057 A1 * 1/2007 Ward ..... 296/20

FOREIGN PATENT DOCUMENTS

| | | |
|---|---|---|
| JP | 2-33773 | 9/1990 |
| JP | 6-75466 | 10/1994 |
| JP | 9-327481 | 12/1997 |
| JP | 2000-217864 | 8/2000 |
| WO | 2004-078087 | 9/2004 |

* cited by examiner

*Primary Examiner*—Kiran B. Patel
(74) *Attorney, Agent, or Firm*—Cantor Colburn LLP

(57) ABSTRACT

A stretcher comprising an upper frame for placing a litter thereon, having casters on a front leg and a rear leg; a constant load spring serving as a slide mechanism for changing the position of the upper frame vertically; a pin lock mechanism for fixing the upper frame having been moved vertically at an arbitrary position; a trapezoidal concave-shaped fitting groove for fixing the head side of a litter to the front end part of the upper frame; and a C-shaped hook for fixing the foot side of the litter to the rear end part of the upper frame, characterized in that a vertically and longitudinally adjustable lock supporter engaging with a lock piece for fixing the stretcher installed on the cargo bed of an ambulance or the like is provided in the rear part of the stretcher, and the pin lock mechanism is mounted with an emergency lever.

5 Claims, 25 Drawing Sheets

4—1

4—2

4—3

16−1

16−2

16−4

16−3

18-1

18-2

20-1

20-2

20-3

ON-VEHICLE STRETCHER AND LITTER

CROSS REFERENCE

This is a continuation-in-part (CIP) application under 35 USC 120 of pending International application JP PCT/JP2005/014641 filed Aug. 10, 2005 which claims priority to JP Pat Appln #2004-373729 filed Dec. 24, 2004 and JP Pat Appln #2005-183337 filed Jun. 23, 2005, priority to all of said applications is also claimed herein, and all disclosures of said applications are also incorporated by herein by reference.

TECHNICAL FIELD

The present invention relates to a stretcher placed on an ambulance or the like and a litter placed on the stretcher. More particularly, it relates to a stretcher having a fixture for fixing the stretcher on the cargo bed of an ambulance or the like and a locking element fixable to the cargo bed of the ambulance or the like mounting with the fixture, and a litter placed on the stretcher, the stretcher being mounted with a easily openable/closable fall preventive shielding plate and a hanger for hanging a drip-feeding bottle or bag at the side of the litter.

BACKGROUND ART

Regarding a stretcher placed on the cargo bed of an ambulance or the like and a litter placed on the stretcher, there has been reported a stretcher which can be placed on a cargo bed of an ambulance or the like and fixed easily, and the height of which can be adjusted easily so as to match the position of an acute patient at a first-aid rescue site. Further, on the shape etc. of the litter placed on the stretcher for carrying the acute patient, many improvements have been proposed.

Patent Document 1 has disclosed a stretcher characterized in that a constant load spring is used for a slide mechanism for changing the position of the upper frame of stretcher vertically; a mechanical lock mechanism is provided to stop the upper frame of stretcher at an arbitrary position; and further there are provided a lock mechanism for fixing the slide of a front leg aiding frame for aiding the front leg of stretcher, and a roller for smoothening the slide between support parts of a front leg, a front leg aiding frame, and a rear leg aiding frame for aiding a rear leg and a center rail, and a litter placed on the stretcher.

Patent Document 2 has disclosed a knee drawing-up type stretcher in which a bending angle adjusting means of an upper leg support part and a lower leg support part is configured at a low cost; adjustment can be made while saving the labor and time; the position of a leg fixing element fitted in the leg part of the knee drawing-up type stretcher can be adjusted easily and rapidly; and the raising/falling operation of a protecting frame installed on both right and left sides of the knee drawing-up type stretcher can be performed easily and rapidly.

Patent Document 3 has disclosed "an ambulance bed fixing device comprising a hollow bar fixed along the inner wall of an ambulance body; a fixing hook provided in one end part of the hollow bar to hook one leg part of bed; a positioning piece provided in the other end part of the hollow bar to make contact with the other leg part of bed; a movable hook holding the leg part between the positioning piece and the movable hook; and an operating rod for the movable hook, provided projectingly at the other end of the hollow bar, the operating rod comprising a pipe part mounted slidably in the outer peripheral part of the hollow bar to always urge the movable hook toward the positioning piece side in cooperation with the movable hook; a control lever provided integrally at the end of the pipe part to turnably lock the pipe part at the separation position of the movable hook with respect to the positioning piece; and an unlocking actuator for unlocking the pipe part by reversing it by contacting with the bed" described in claim.

Patent Document 4 has disclosed "a vehicle with a fixture, characterized by having a holder for fixing a stretcher provided on a floor panel; a second holder arranged on the floor panel to fix an incubator; and a holding means that turnably supports the second holder, and turns the second holder to retract it from an indoor occupation region that the stretcher occupies when the stretcher is fixed by the first holder" in claim 1. The fixture of stretcher in Patent Document 1 fixes the stretcher together with the second holder urging the first holder at the front and a spring at the rear.

Patent Document 5 is a patent document relating to a stretcher fixture that fixedly places a stretcher in a first-aid vehicle, and has disclosed a stretcher fixture capable of alleviating the worker's burden and preventing noise through an increase in an urging force of an urging means by using a configuration in which an operating force need not be applied continuously to an operating grip. The construction is disclosed as "the stretcher fixture in accordance with the present invention includes a body pipe fixed in a substantially horizontal state in the vehicle; a front locking claw fixed in the front part of the body pipe to lock one leg pipe at the front or rear of the stretcher; a positioning piece fixed in the rear part of the body pipe to determine the locking position of the other leg pipe at the front or rear of the stretcher; an operating grip arranged on the rear end side of the body pipe, in which the operation force to the front is applied from the outside; an operating rod the rear end of which is connected to the operating grip and which is provided on the inside of the body pipe so as to be capable of advancing and retreating; an urging means arranged in the body pipe to always apply an urging force to the rear with respect to the operating rod; and a rear-side locking claw that is connected to the operating rod, advances and retreats according to the movement of the operating rod, and, at the time of retreat, pushes the other leg pipe on the positioning piece by means of the urging force of the urging means to lock the other leg pipe by pushing the other leg pipe on the positioning piece, and is characterized in that a stopper is provided between the positioning piece and the rear-side locking claw; when the operation force to the front is applied to the operating grip from the outside, the stopper projects to the outside in the radial direction of the body pipe to allow the rear-side locking claw to be locked; and when the rear-side locking claw is in a locked state, if being pressed by the other leg pipe, the stopper retracts to the inside in the radial direction of the body pipe to allow the rear-side locking claw to retreat" from the second line of paragraph [0007].

Patent Document 1: WO2004/078087

Patent Document 2: Japanese Unexamined Utility Model Application Publication No. 06-75466

Patent Document 3: Japanese Examined Utility Model Application Publication No. 02-33773

Patent Document 4: Japanese Unexamined Patent Application Publication No. 09-327481

Patent Document 5: Japanese Patent Application No. 2000-217864

Although the stretcher and the litter placed on the stretcher have been improved variously, a satisfactory stretcher and a satisfactory litter have not yet been realized. It is desired to realize a litter capable of being placed on a stretcher quickly, capable of being fixed to the stretcher reliably, and capable of being placed on a stretcher on which a patient is examined at the time of first aid or is put on a drip.

Also, in order to place the stretcher on the cargo bed of an ambulance or the like and to carry it, it is necessary to firmly fix the stretcher to the cargo bed of the ambulance or the like so that the stretcher does not move even during the time when the ambulance or the like runs. However, when the stretcher is fixed to the cargo bed of the ambulance or the like, not only the stretcher must be fixed firmly so that the stretcher does not move even during the time when the ambulance or the like runs, but also the stretcher must be taken out of the cargo bed of the ambulance or the like quickly to receive a patient quickly when the ambulance or the like arrives at the first aid rescue site. In order to receive the patient and to place and fix the stretcher to the cargo bed of the ambulance or the like quickly, it is necessary that the stretcher be attached and detached easily and can be fixed firmly. Therefore, it is desired to realize a litter capable of receiving a patient safely and quickly and a fixture etc. for easily fixing the stretcher on which the litter is placed to the cargo bed of the ambulance or the like.

In the present invention, an ambulance or the like means an automobile provided with equipment (referred to as "a stretcher") having a structure for carrying a patient etc. when the patient etc. enter or leave a medical institution, go to a hospital regularly, transfer to another hospital, or are picked up and dropped off at a social welfare facility etc. (hereinafter referred to as "a patient carrying automobile")

DISCLOSURE OF THE INVENTION

Problems to be Solved by the Invention

An object of the present invention is to provide a fixture capable of reliably fixing a stretcher to the cargo bed of a patient carrying automobile by being adjusted easily even if the patient carrying automobile on which the stretcher is placed changes in the case where the stretcher is placed on the cargo bed of the patient carrying automobile, and a litter placed on the stretcher and having an easily openable shielding plate stretched at the side thereof to easily put a patient on and down.

Means for Solving the Problems

As the result of earnest studies for solving the above problems, the inventor succeeded in providing a stretcher having a fixture for fixing the stretcher to the cargo bed of a patient carrying automobile even in the case where the vehicle type of the patient carrying automobile differs and a supporter that is easily adjustable so as to match the height and longitudinal position of the fixture, and a litter placed on the stretcher, which is stretchedly mounted with an easily openable shielding plate at the side of the litter.

The invention described in claim 1 provides a stretcher including an upper frame for placing a litter thereon; a trapezoidal concave-shaped fitting groove for fixing the head side of a litter to the front end part of the upper frame; and a C-shaped hook for fixing the foot side of the litter to the rear end part of the upper frame, characterized in that the stretcher further includes a constant load spring serving as a slide mechanism for changing the position of the upper frame vertically; and a pin lock mechanism for fixing the upper frame having been moved vertically at an arbitrary position, and an adjustable lock supporter engaging with a lock piece for placing the stretcher on an ambulance or the like and fixing the stretcher installed on the cargo bed of the ambulance or the like is installed. Herein, the ambulance or the like means a patient carrying automobile provided with equipment (referred to as "a stretcher") having a construction for carrying a patient etc. when the patient etc. enter or leave a medical institution, go to a hospital regularly, transfer to another hospital, or are picked up and dropped off at a social welfare facility etc. In placing the stretcher on the patient carrying automobile, a lock piece for fixing the stretcher installed on the cargo bed of the patient carrying automobile and a lock supporter installed in the lower part of the stretcher to engage with the lock piece are made adjustable, by which adjustment can be made easily even if the type of patient carrying automobile differs, and the stretcher can be placed and fixed stably on the cargo bed of the patient carrying automobile.

The stretcher in accordance with the present invention differs from the stretcher in Patent Document 1 in that a pin lock mechanism for fixing the stretcher at an arbitrary position and the lock supporter adjustable longitudinally and vertically so as to engage with the lock piece for fixing the stretcher installed on the cargo bed of the ambulance or the like are installed in the rear part of the stretcher.

The invention described in claim 2 provides a litter for being placed on the stretcher, which has a trapezoidal convex-shaped fitting part having a slant surface to be engaged with a fitting groove provided in the front end part of the stretcher, characterized in that a wheel is provided at one end of a frame on both sides of the litter; an openable shielding plate is installed on the frame on both sides of the litter; and the shielding plate can be unlocked and opened/closed by gripping any of three directions of the right, left, and upper parts of an inside frame of the shielding plate. In placing the litter on the stretcher, the trapezoidal convex-shaped fitting part having a slant surface, which is installed in the tip end part of the litter, engages with the fitting groove provided in the front end part of the stretcher, so that the rear part of the litter can be fixed to the stretcher easily by a C-shaped hook. Further, since there is provided the shielding plate capable of being unlocked by gripping any of three directions of the right, left, and upper parts of the inside frame of the shielding plate provided at the side of the litter, the shielding plate can be unlocked and opened/closed from any of three directions of the right, left, and upper parts of the inside frame of the shielding plate when a patient is put on and down from the litter or is subjected to drip-feeding or other examinations at the time of emergency.

The invention described in claim 3 provides the litter for being placed on a stretcher according to claim 2, characterized in that a hanger for hanging a drip-feeding bottle or bag is mounted on a litter frame. By mounting the hanger for hanging a drip-feeding bottle or bag on the frame at the side of the litter, the patient on the litter can be put on a drip on both of the inside and the outside of the patient carrying automobile, which increases the first-aid lifesaving effect.

The invention described in claim 4 provides the litter for being placed on a stretcher according to claim 2, characterized in that the transverse width of a mat mounted on the litter frame is wider in the shoulder part than in the trunk part. By mounting the mat such that the shape of the mat mounted on the frame on both sides of the litter is such that the shoulder part is wider than the trunk part, a sense of stability is given to the patient, and also emergency treatment such as drip-feeding and examination is easy to perform.

The invention described in claim 5 provides a stretcher fixture installed on the floor surface of the cargo bed of an ambulance or the like to fix the stretcher to the cargo bed of the ambulance or the like, characterized by including a front hook which is mounted on the front floor surface of the cargo bed of an ambulance or the like to fix the front part of the stretcher; and a lock plate which is installed on the rear floor surface and has a lock piece engaging with a lock supporter installed in the rear part of the stretcher. Herein, the ambulance or the like means the patient carrying automobile. When the stretcher is placed on the patient carrying automobile, by the front hook for fixing the front part of stretcher onto the floor surface of cargo body of the ambulance or the like and the lock piece engaging with the lock supporter installed in the rear part of the stretcher, the front and rear of the stretcher placed on the cargo bed of patient carrying automobile can be fixed firmly, and in an emergency, the stretcher can be pulled out immediately merely by unlocking the lock piece.

The invention described in claim 6 provides the stretcher fixture according to claim 5, characterized in that the front hook is mounted with a cushioning member in a portion in which the frame of the stretcher makes contact. When the stretcher is pushed onto the cargo bed from the rear part of the patient carrying automobile, the stretcher comes into contact with the front hook installed in the front part. If the operation of pushing the stretcher from the rear part of the patient carrying automobile is performed repeatedly, even if attention is paid, the stretcher frame or the front hook may be damaged, or in the case where a patient is placed on the stretcher, a shock may be given to the patient. The mounting of the cushioning member on the front hook achieves an effect that the frame is not damaged, or no shock is given to the patient.

The invention described in claim 7 provides the stretcher fixture according to claim 5, characterized in that the lock plate includes a lock piece; a rail provided with many irregularities under the lock piece; a pin that engages with a concave portion of the irregularities of the rail and is urged by a spring member; and a lever for operating the detachment of the pin. The rail provided with many irregularities under the lock piece and the pin that engages with the concave portion of the irregularities of the rail and is urged by the spring member engage with the concave portion from the upside toward the downside, by which the lock piece is fixed. Since the pin urged by the spring engages from the upside toward the downside and the pin is pressed by the urged spring, an effect is achieved that the pin is less liable to come off due to vibrations at the time when the patient carrying automobile runs.

The invention described in claim 8 provides the stretcher fixture according to claim 5, characterized in that the lock piece can be operated longitudinally with one hand while raising the lever of the lock plate. When the lever is raised from above the lock piece installed on the lock plate, the pin comes off the concave portion on the rail and the lock piece becomes longitudinally movable. When the lock piece is unlocked while the stretcher is supported with one hand and the lever is raised with the other hand, and the lock piece is separated from a support part on the rail and is brought down to either of the right and left, the stretcher can be pulled out of the cargo bed of the patient carrying automobile. By fixing the lock piece using the pin that engages with the concave portion of the irregularities of the rail and is urged by the spring, the lever operation for performing the detachment of pin and the operation for longitudinally moving the lock piece can be performed with one hand, and the stretcher can be supported with the other hand, so that an unexpected accident such that the stretcher released from the locked state runs out, for example, on a slope can be prevented.

Effects of the Invention

The constant load spring serving as a slide mechanism for changing the position of the upper frame vertically and the pin lock mechanism for fixing the upper frame having been moved vertically at an arbitrary position are used. Therefore, the height of the stretcher can be adjusted quietly and quickly.

The lock supporter that is adjustable longitudinally and vertically so as to match the lock piece for fixing the stretcher installed on the cargo bed of the patient carrying automobile is installed in the bottom part of the stretcher. Therefore, even if the type of patient carrying automobile is changed, the height and the longitudinal position of the lock supporter can be adjusted easily.

The shielding plate capable of being unlocked from any of three directions of the right, left, and upper parts is provided at the side of the litter. Therefore, the safety of the patient on the litter can be maintained by closing the shielding plate, and also the shield plate is unlocked from any of three directions of the right, left, and upper parts, by which the patient can be put on or down easily and medical treatment such as examination with a stethoscope and drip-feeding can be performed easily.

The fixture consisting of the front hook installed in the front part of cargo bed of the ambulance or the like and the lock plate installed in the rear part of the cargo bed gently receives the front part of the stretcher by means of the front hook, and reliably fixes the rear part of the stretcher placed on the ambulance or the like by means of the lock piece engaging with the lock supporter of the lock plate installed in the rear part. Also, the fixture has a construction such that it can be released easily and the stretcher can be taken out easily.

BRIEF DESCRIPTION OF THE DRAWINGS

FIG. 24 is a partial side view showing a state in which a front hook and a lock plate are installed on a cargo bed of an ambulance or the like.

EXPLANATION OF REFERENCE NUMERALS

Figure 1:
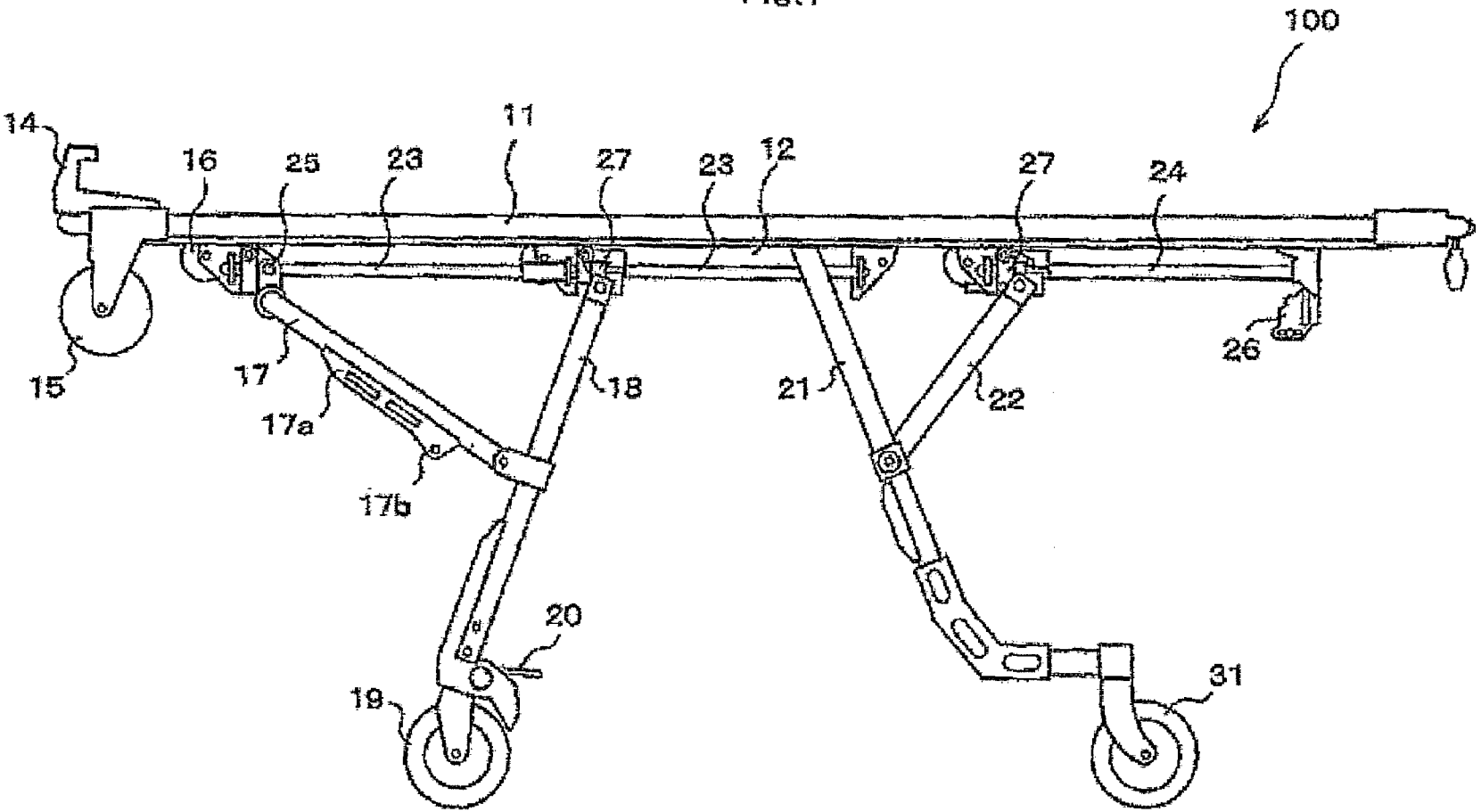
FIG. 1 is a side view of a stretcher.

100 . . . stretcher
200 . . . litter placed on stretcher
300 . . . stretcher fixture
11 . . . upper frame
12 . . . center frame
13 . . . internal frame
14 . . . fitting groove
15 . . . fixed caster
16 . . . constant load spring
17 . . . front leg part aiding frame
18 . . . front leg part
19 . . . front leg part caster
20 . . . stopper
21 . . . rear leg part
22 . . . rear leg part aiding frame
23 . . . front leg part sliding pipe, front leg part aiding frame sliding pipe
24 . . . rear leg part aiding frame sliding pipe
25 . . . lock pin
26 . . . lock supporter of litter
27 . . . lock pin
28 . . . pin lock mechanism
29 . . . lock groove
30 . . . wire
31 . . . rear leg part caster
32 . . . fitting part
33 . . . litter frame
34 . . . back part
35 . . . back part lever
36 . . . lever of pin lock mechanism
37 . . . shielding plate
38 . . . litter lever
39 . . . litter fixing C-shaped hook
40 . . . leg part
41 . . . leg part lever
42 . . . hanger for hanging drip-feeding bottle or bag
43 . . . hanger supporting member
44 . . . hanger connecting member
45 . . . litter mat
46 . . . litter caster
47 . . . gripping part
48 . . . front hook
49 . . . front plate
50 . . . lock plate
51 . . . lock piece
52 . . . under plate
53 . . . lever
54 . . . pin
55 . . . rail
56 . . . fixing part
57 . . . anchor plate
58 . . . litter mat
59 . . . conventional shielding plate

BEST MODE FOR CARRYING OUT THE INVENTION

A stretcher placed on a patient carrying automobile and a litter placed on the stretcher in accordance with the present invention will now be described in detail with reference to the accompanying drawings. The present invention is not limited to an example described below. Also, the patient carrying automobile on which the stretcher and the litter in accordance with the present invention are placed is not limited to an ambulance for receiving and carrying a patient in case of emergency. The patient carrying automobile includes a vehicle capable of placing the stretcher, such as a motor hearse, in addition to the ambulance provided with equipment (referred to as "a stretcher") for carrying a patient etc. when the patient etc. enter or leave a medical institution, go to a hospital regularly, transfer to another hospital, or are picked up and dropped off at a social welfare facility etc.

As shown in FIG. 1, a stretcher 100 in accordance with the present invention includes, in the upper part thereof, an upper frame 11 for placing a litter, a trapezoidal concave-shaped fitting groove 14 for fixing the head side of litter to the front end part of the upper frame 11, and a C-shaped hook 39 (not shown) for fixing the foot side of litter to the rear end part of the upper frame 11. Also, the upper frame 11 is fitted with a plurality of internal frames 13. A center frame 12 is fitted to the internal frames 13, and a front leg part aiding frame, a front leg part sliding pipe 23, and a rear leg part aiding frame sliding pipe 24 are fitted at both sides of the center frame 12. The stretcher 100 in accordance with the present invention has a constant load spring 16 serving as a slide mechanism for changing the position of the upper frame 11 vertically and a pin lock mechanism (FIGS. 5 and 6) for fixing the upper frame having been moved vertically at an arbitrary position in order that the stretcher may be moved vertically to place a patient or a litter thereon and the patient or the litter may be placed on the stretcher by fixing the stretcher at a proper position.

The stretcher 100 used in case of emergency must be placed rapidly without being vibrated so that a passenger placed on the patient carrying automobile does not suffer pain. For the stretcher 100 in accordance with the present invention, the upper parts of a front leg part aiding frame 17, a front leg frame 18, and a rear leg part aiding frame 22 are fixed by lock pins 25, 27, 27, respectively. Each of the lock pins 25, 27, 27 is connected to a lever 36 (FIG. 5) in the front or rear part of the stretcher with a wire 30. In an emergency, the litter must be placed rapidly on the stretcher, and the litter must be fixed safely to the stretcher.

Figure 2:
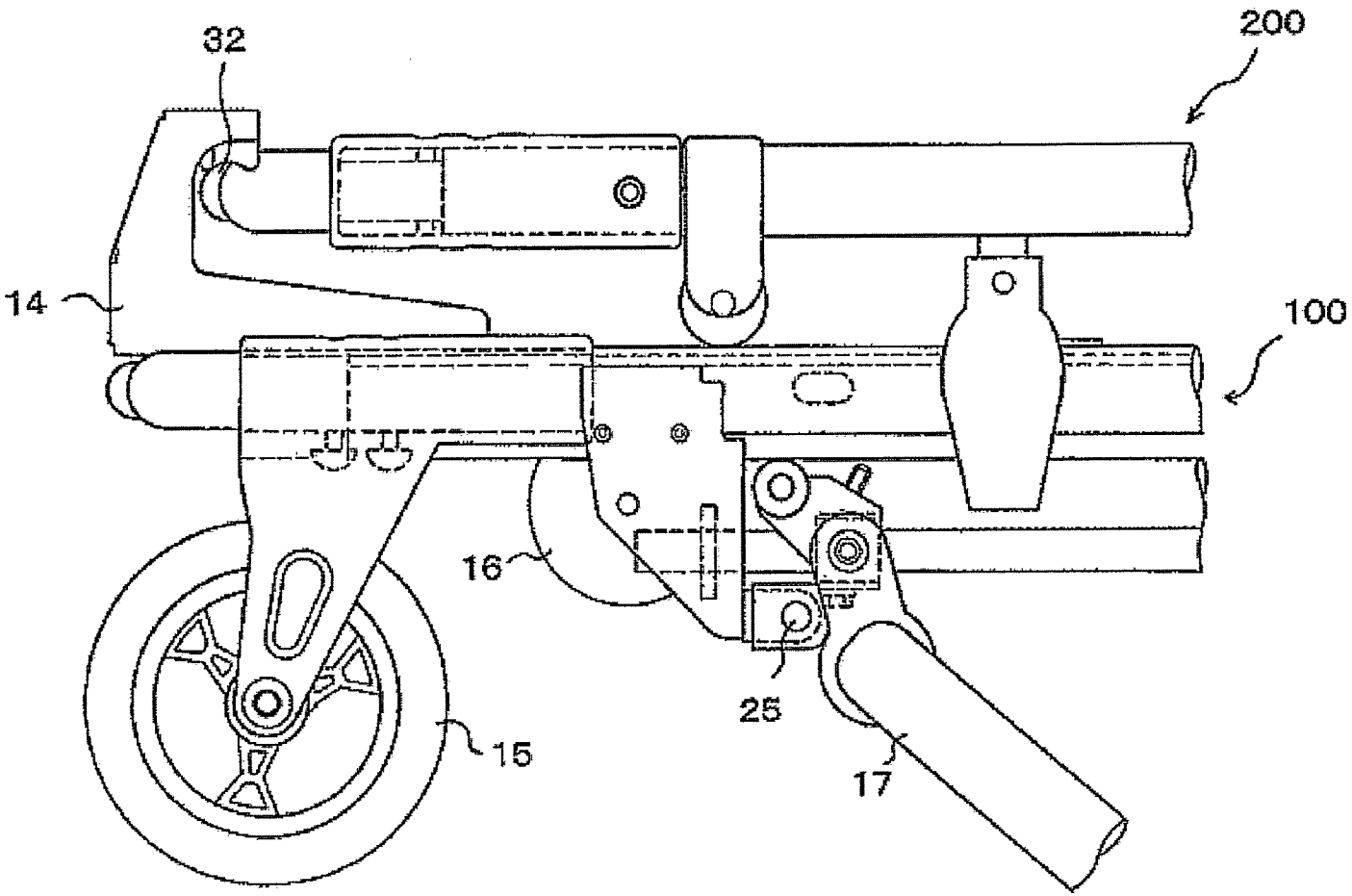
FIG. 2 is a side view showing a state in which a litter is fitted to a stretcher.
Figure 3:
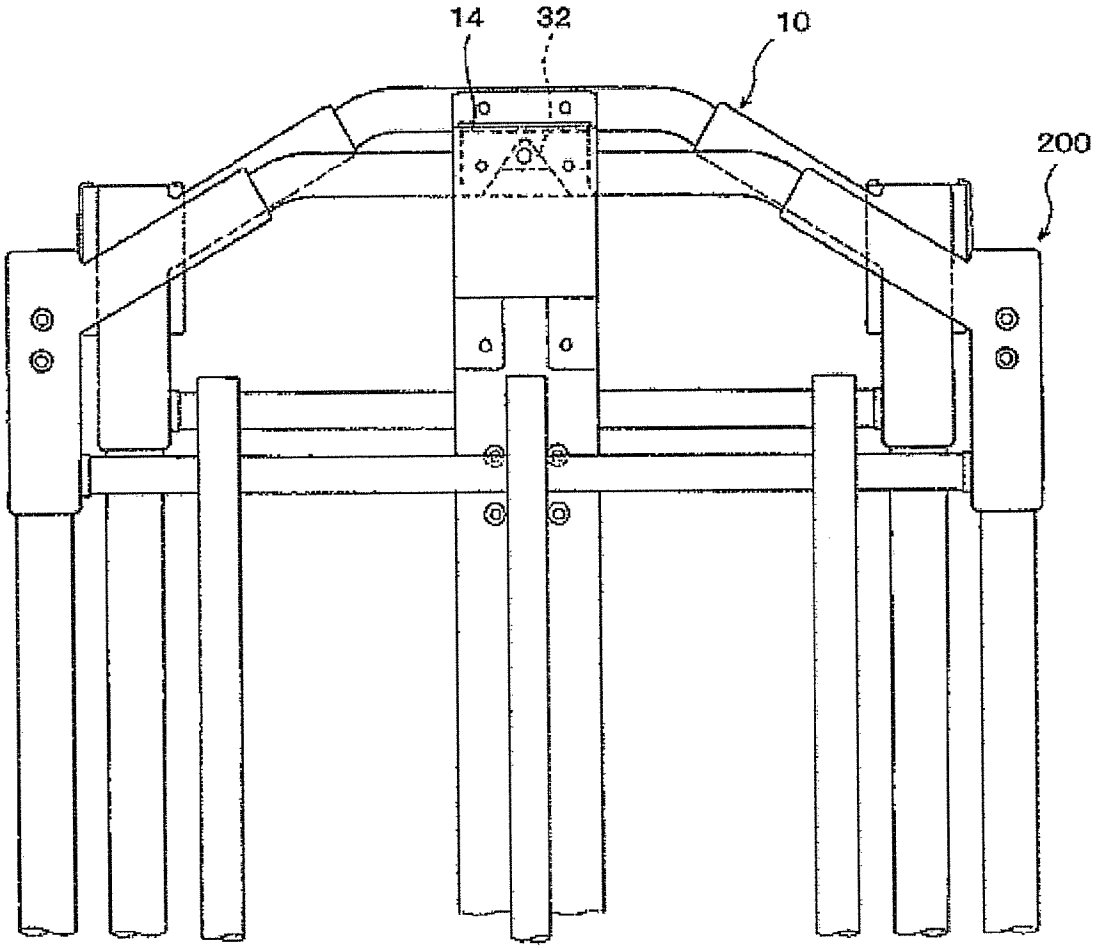
FIG. 3 is a top view showing a state in which a litter is fitted to a stretcher.

In order to fix the litter safely to the stretcher, for the stretcher 100 in accordance with the present invention, as shown in FIGS. 2 and 3, the fitting groove 14 for receiving the litter placed from the rear of the stretcher is fitted above the center frame 12. In the fitting groove 14, a fitting part 32 of litter shown in FIG. 3 fits, by which the head side of litter is held stably on the stretcher. The inlet of the fitting groove 14 is wide, and the inner part thereof has a narrow triangular shape. Therefore, the fitting part 32 provided at the tip end of the litter engages easily with the fitting groove 14, and when the fitting part 32 is pushed into the inner part of the fitting groove 14, the fitting part 32 fits into the narrow portion, and hence the head side is held stably. The foot side of the litter is fixed to the stretcher by a litter fixing C-shaped hook 39 (not shown) for fixing the litter, which is installed in the rear part of the stretcher. Thus, the litter 200 in accordance with the present invention is fixed firmly at two places on the head side and on the foot side on the stretcher 100 in accordance with the present invention, and thereby is held stably.

Further, as shown in FIG. 1, in the front part of the upper frame 11 of the stretcher 100 in accordance with the present invention, a fixed caster 15 is mounted in the front part of the stretcher so that the litter can be pushed smoothly on the cargo bed of the patient carrying automobile when the litter is placed on the patient carrying automobile. When the litter is pushed on the cargo bed of the patient carrying automobile by using the fixed caster 15, the front leg part aiding frame 17 comes into contact with the cargo bed and is pushed to the rear, and the lock pin 25 is released, by which the front leg part 18 is pushed to the rear and folded. When the front leg part 18 is folded, a small wheel 17*b* mounted on a vibration absorbing member 17*a* installed on the front leg part aiding frame 17 rides on the cargo bed, and advances smoothly on the cargo bed by using the small wheel 17*b*. When the front leg part is folded, the litter is pushed quietly on the cargo bed by using the front caster 15. Finally, the rear leg part 21 is folded, by which the stretcher 100 can be placed quietly on the cargo bed of the patient carrying automobile. In place of the small wheel 17*b* used at this time, a plurality of grooves etc. are provided in the surface through which the vibration absorbing member 17*a* makes contact with the floor to improve the slide of the vibration absorbing member 17*a*. In this case, the small wheel 17*b* need not be installed especially.

For the stretcher 100 placed on the cargo bed of the patient carrying automobile, a lock piece (not shown) for fixing the stretcher 100, which is installed on the cargo bed of the patient carrying automobile, engages with a lock supporter 26 installed in the bottom part of the stretcher 100. By engaging the lock supporter 26 of the stretcher 100 with the lock piece installed on the cargo bed of the patient carrying automobile, the stretcher 100 can be held stably on the cargo bed.

Figure 4:
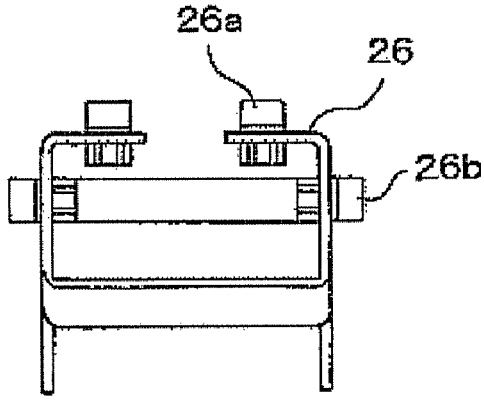
FIG. 4 is a side view of a locking element of a stretcher.
Figure 4:
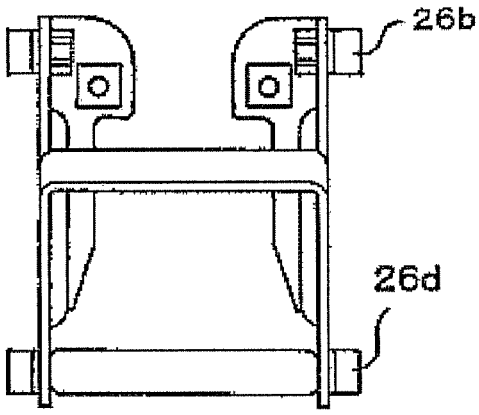
Figure 4:
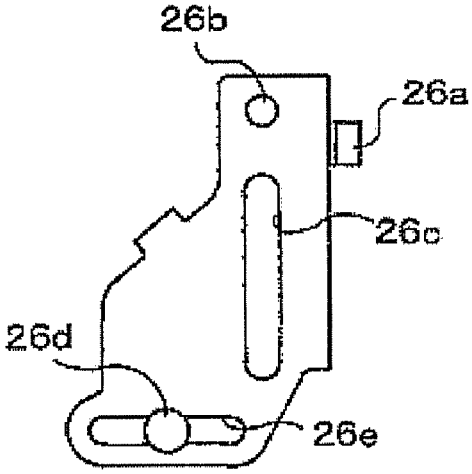

As shown in FIG. 4, even if the patient carrying automobile is changed, and thus the longitudinal position and the height of the lock piece for fixing the litter on the cargo bed of the patient carrying automobile are changed, the lock supporter 26 of the stretcher 100 in accordance with the present invention has a feature of being adjustable longitudinally and vertically so as to match the changed position and height of the lock piece. FIG. 4-1 is a top view of the lock supporter, FIG. 4-2 is a front view thereof, and FIG. 4-3 is a side view thereof. The lock supporter 26 of the litter is fixed to a lock supporter installation part in the lower part of the stretcher with screws 26*a*. The height of the lock supporter 26 of litter is adjusted by moving screw holes 26*a* vertically in an elongated hole formed in the lock supporter installation part, and the longitudinal position thereof is adjusted by moving a screw hole 26*d* in an elongated hole 26*e*. A groove 26*c* is a concave portion provided to enhance the strength of the lock supporter 26 of the litter.

Figure 5:
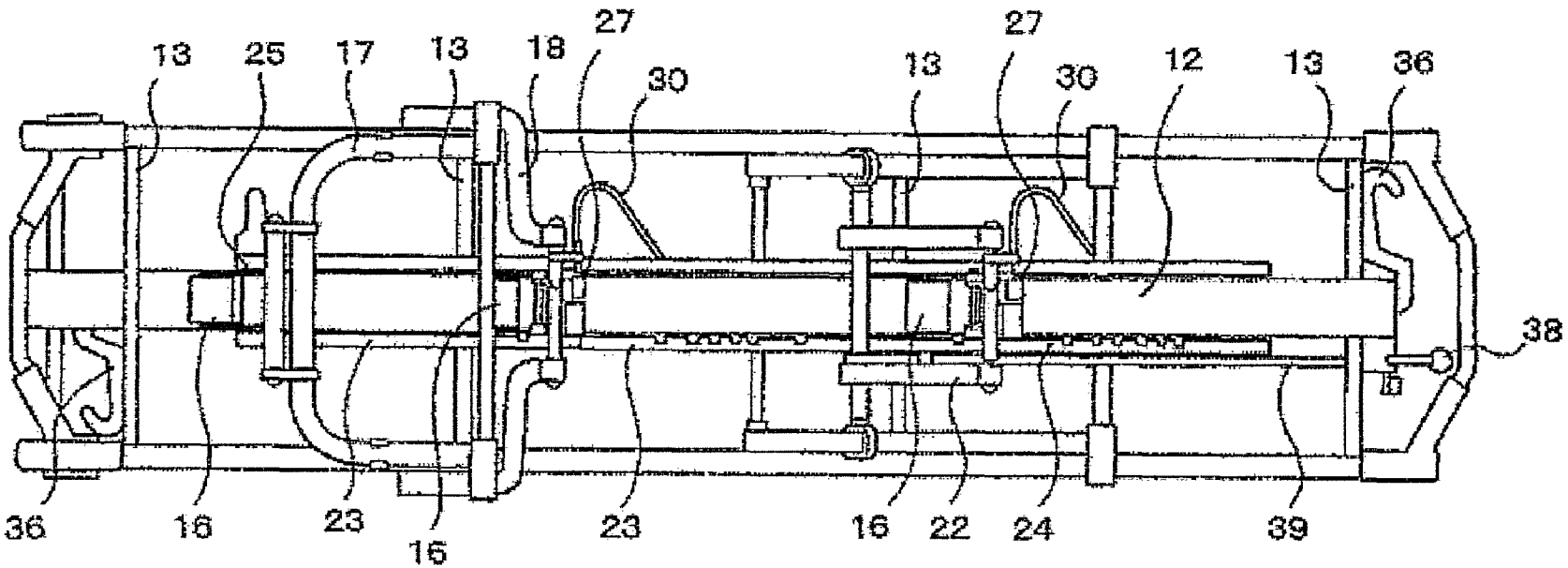
FIG. 5 is a bottom view of a stretcher.

FIG. 5 shows the lower surface of the stretcher 100. On the center rail 12, the three constant load springs 16 are provided at a total of three places: one place of the lock pin 25, and two places of the lock pins 27, 27. The lock pin 25 is mounted on the front leg part aiding frame 17, and the lock pins 27 are mounted on the front leg part frame 18 and the rear leg part aiding frame 22. Each of the lock pins 25, 27, 27 is connected to the front or rear lever 36 with the wire 30. When the front lever 36 is pulled, the lock pin 27 of the front leg part frame 18 is released from a lock groove 29. When the rear lever 36 is pulled, the lock pin 25 of the front leg part aiding frame 17 and the lock pin 27 of the rear leg part aiding frame 22 are released from a lock hole 25 (a hole with which the lock pin 25 engages, not shown) and the lock groove 29, respectively. In the case where a patient is placed on the stretcher, when the front and rear levers 36 are pulled, all of locks are released. When the stretcher is pushed to a proper position in the state in which the front and rear levers 36 are pulled, the front leg part frame 18 and the rear leg part frame 21 are opened longitudinally in the state in which the front leg part frame 17 is in contact at a fixed position, so that the stretcher can be lowered to an arbitrary position. The stretcher 100 can be fixed at a vertical position with an arbitrary height by engaging the two lock pins 27, 27 of the front leg part frame 18 and the rear leg part aiding frame 22 with arbitrary positions in the lock grooves 29, 29 formed in the sliding pipes 23, 24. A litter lever 38 is a lever for releasing a stopper (not shown) for fixing the foot side of the litter 200. By pulling the litter lever 38, a litter fixing C-shaped hook 39 that fixes the foot side of litter is released, so that the litter 200 can be put down from the stretcher 100.

In the case where the stretcher is placed on the patient carrying automobile, the stretcher is pushed while the lever 36 in the rear part of the stretcher is pulled, by which the stoppers for the front leg part aiding frame 17 and the rear leg part aiding frame 22 are released, and the front leg part frame 18 and the rear leg part frame 21 that come into contact with the cargo bed of the patient carrying automobile are pushed to the rear, so that the front and rear leg parts are folded to the rear and placed on the cargo bed of the patient carrying automobile.

In the case where the stretcher 100 is put down from the patient carrying automobile on which the stretcher is placed, the stretcher is pulled out from the rear while the rear lever 36 is pulled, by which the leg parts are spread by the constant load spring in the order of the rear leg part frame 21 and the front leg part frame 18, so that the stretcher 100 becomes in an immediately usable state. If the angle of the lock groove 29 on the side on which the lock pin 27 is removed is increased, the leg parts are spread in the order of the rear leg part frame 21 and the front leg part frame 18 without the operation of the lever 36 in the rear part of the stretcher, and thereby the stretcher 100 can be pulled down.

Figure 6:
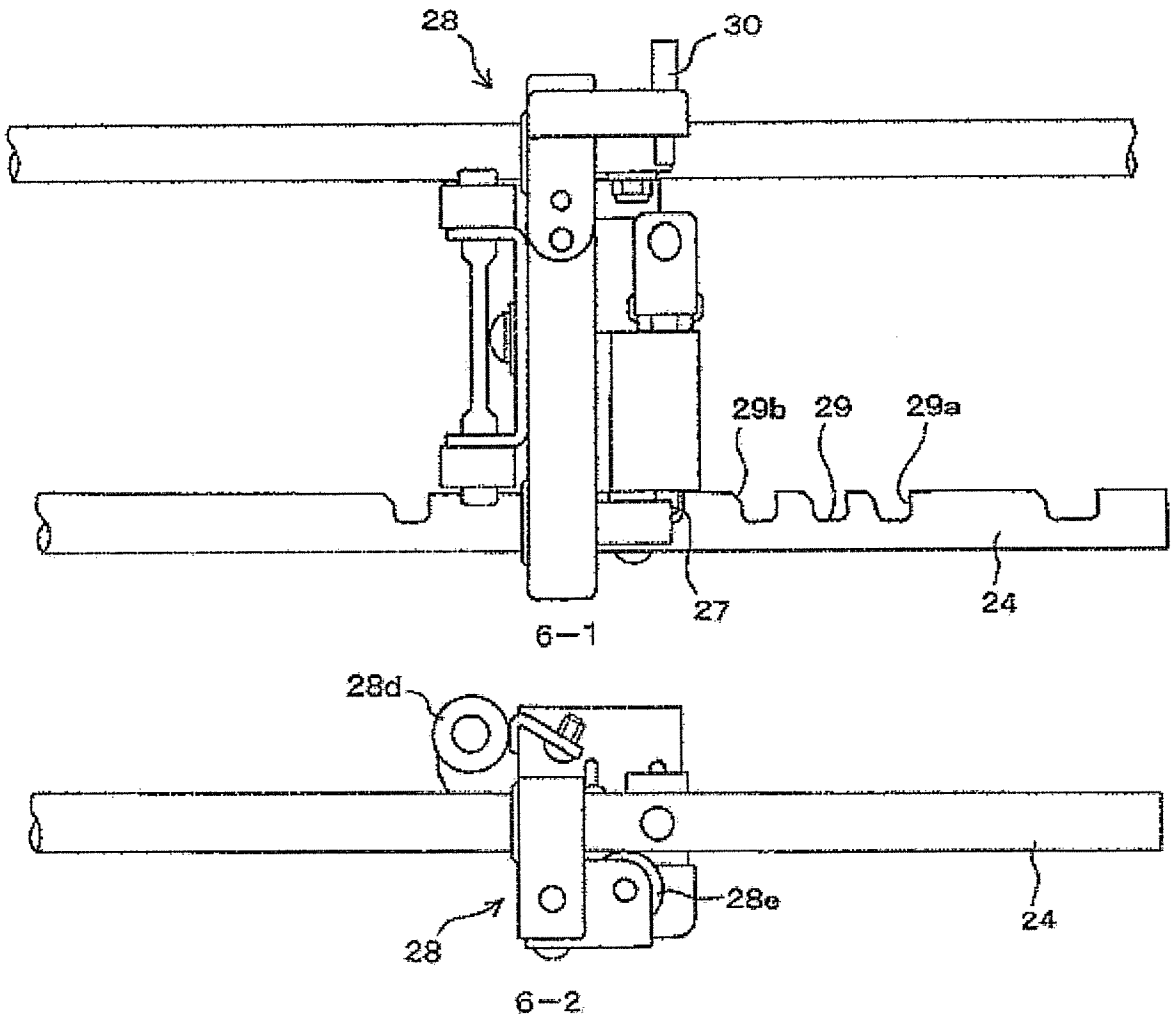
FIG. 6 is a top view and a side view of a pin lock mechanism of a stretcher.

In FIG. 6 (FIG. 6-1), the height of the stretcher 100 is changed to place the litter 200, and the stretcher is fixed at a proper position so that the litter 200 is placed on the stretcher 100. For this purpose, the stretcher 100 in accordance with the present invention is provided with the constant load spring 16 as a slide mechanism for moving the position of the upper frame 11 vertically, by which the stretcher can be moved lightly in the vertical direction without vibrations and without applying a force. Also, the stretcher has a pin lock mechanism 28 as shown in FIG. 6 so that the stretcher 100 is fixed at an arbitrary position after the stretcher 100 has been moved vertically. This pin lock mechanism 28 is connected to the lever 36 at one end of the stretcher 100 with the wire 30. By pulling the front and rear levers 36, the wire 30 is pulled, so that the lock pins 25, 27, 27 are released from the lock hole 25 and the lock grooves 29, 29, and the stretcher 100 becomes in a vertically movable state. When the front and rear levers 36 are released at an arbitrary position, the lock pins 27, 27 engage with the lock grooves 29, 29, and the stretcher 100 are fixed at the arbitrary position. The lock grooves 29, 29 for receiving and locking the lock pins 27, 27 are formed in the sliding pipe 24 or 23 (not shown) as shown in FIG. 6-1. The lock grooves 29, 29 formed in the sliding pipe 24 or 23 (not shown) each have an acute angle 29*a* on the side on which a load is applied so as to be capable of receiving the load sufficiently. Also, the side on which the lock pin 27 is removed has a taper 29*b* so that the lock pin 27 can be removed easily. If the angle of the side on which the lock pin 27 is removed is increased, the construction can be made such that even if the front and rear levers of the stretcher is not operated, the lock pin 27 is engaged with the lock groove 29 merely by raising the stretcher upward. Also, the lock groove 29 may be a hole with which the lock pin engages, not a groove. The lock groove 29 has only to have a shape such that the lock pin can be removed easily and is difficult to remove due to an unexpected load, and the shape engaging with the lock pin is not limited to a groove. FIG. 6-2 shows the side of the pin lock mechanism 28 in a state of being insertedly fitted in the sliding pipe 23 or 24. A roller 28*d* of the lock pin 27 receives the center frame 12, and a roller 28*e* receives the sliding pipe 23 or 24. By providing the roller 28*e*, vibrations of the pin lock mechanism 28 are eased.

Figure 7:
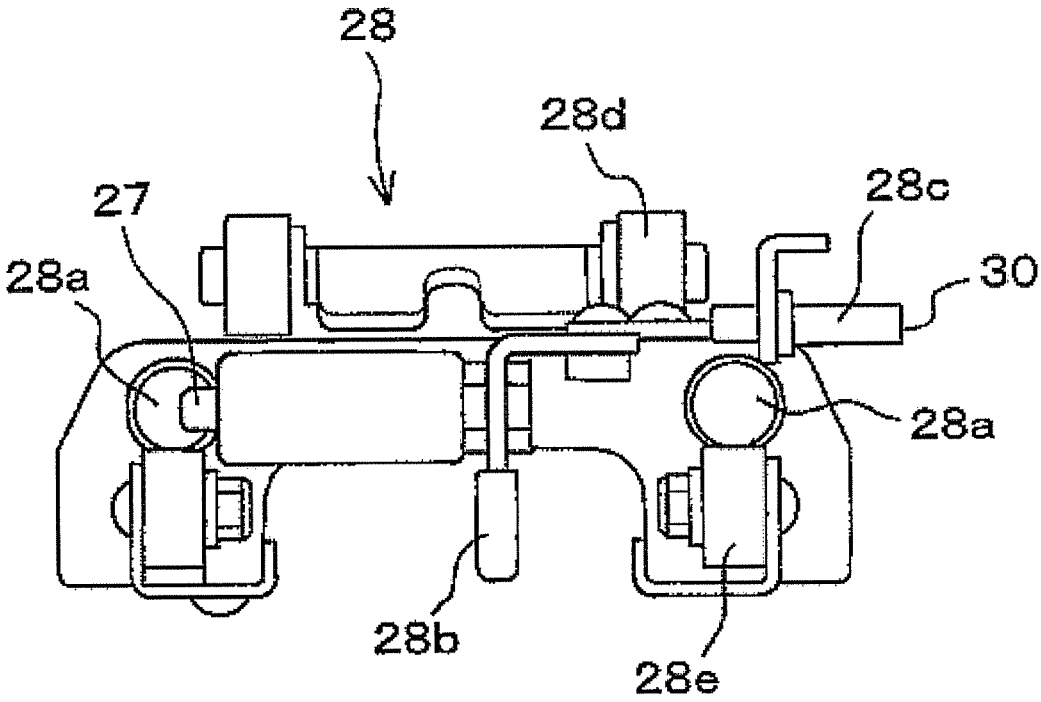
FIG. 7 is a side view of a pin lock.

As shown in FIG. 7, holes 28*a* on both sides formed in the side surface of the pin lock mechanism 28 are holes through which the sliding pipes 23 and 24 are inserted. The sliding pipes 23, 24 on both sides are insertedly fitted in the holes 28*a* so as to slide longitudinally. In the center in the lower part of the pin lock mechanism 28, an emergency lever 28*b* is installed so as to be capable of releasing the lock pin 27 in an emergency. A wire connecting part 28*c* on the side is connected to the lever 36 installed in the end part of the stretcher with the wire 30. The upper roller 28*d* receives the center rail 12, and the lower roller 28*e* receives the sliding pipe 23 or 24, so that the pin lock mechanism 28 is held stably.

Figure 8:
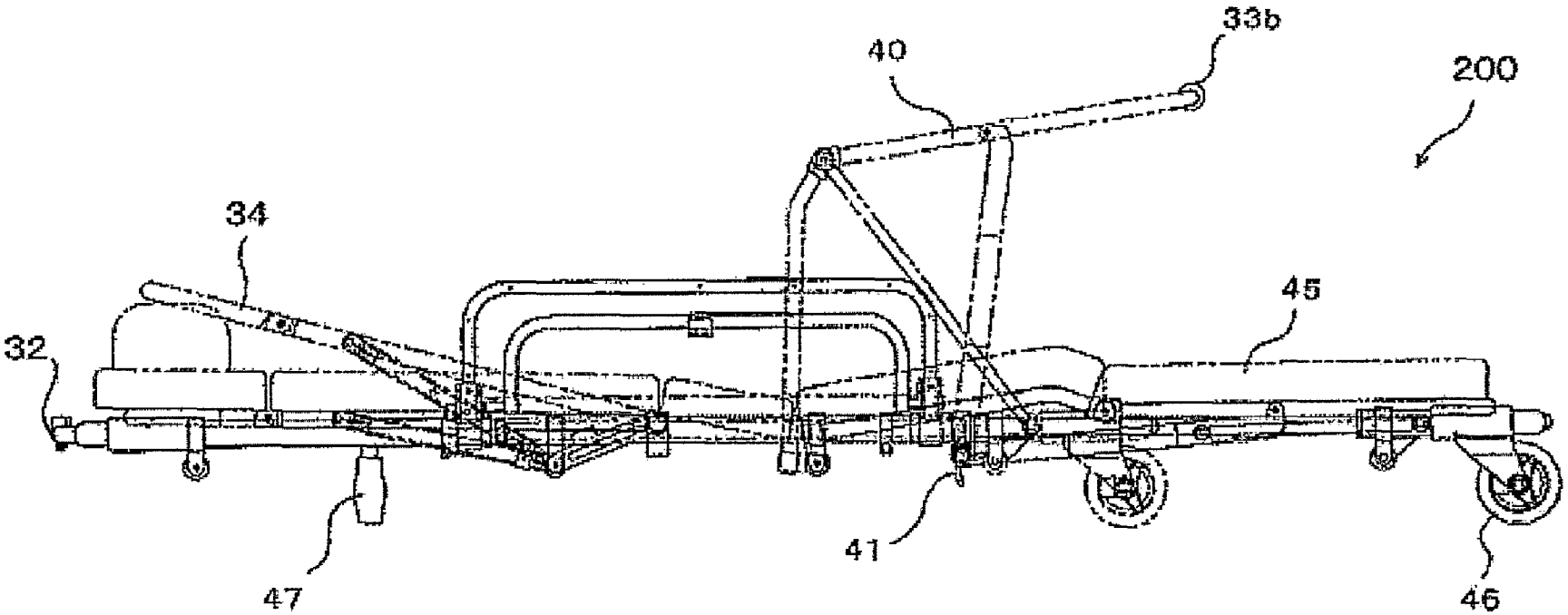
FIG. 8 is a side view of a litter.

FIG. 8 shows the side of the litter 200 in accordance with the present invention that is placed on the stretcher 100 in accordance with the present invention. At the end on the head side of the litter 200, the fitting part 32 engaging with the fitting groove 14 of the stretcher is mounted. For the litter 200 capable of being placed on the stretcher, there may arise a need for changing the shape of the litter 200 according to the condition of the patient or for immediately changing the shape of the litter 200 according to the condition of the site. Therefore, a back part 34 of the litter 200 in accordance with the present invention can be raised upward from the flat surface by pulling a back part lever 35 provided under the back part, so that the upper body of the patient can be made in a raised state. Also, a leg part 40 is made in a chair state by raising a lever 41 under the litter, and then the leg part lever 41 is returned to the original position, by which the patient can be carried in a state of being seated on a chair. If the litter 200 is made in a chair state, the litter can be moved by litter casters 46 mounted at the end of a frame on both sides of the litter. Therefore, the patient can be carried quickly to a stretcher standby place or a parking place of patient carrying automobile, passing through a narrow passage, by one rescue party member in the state of being seated on the litter 200.

Figure 9:
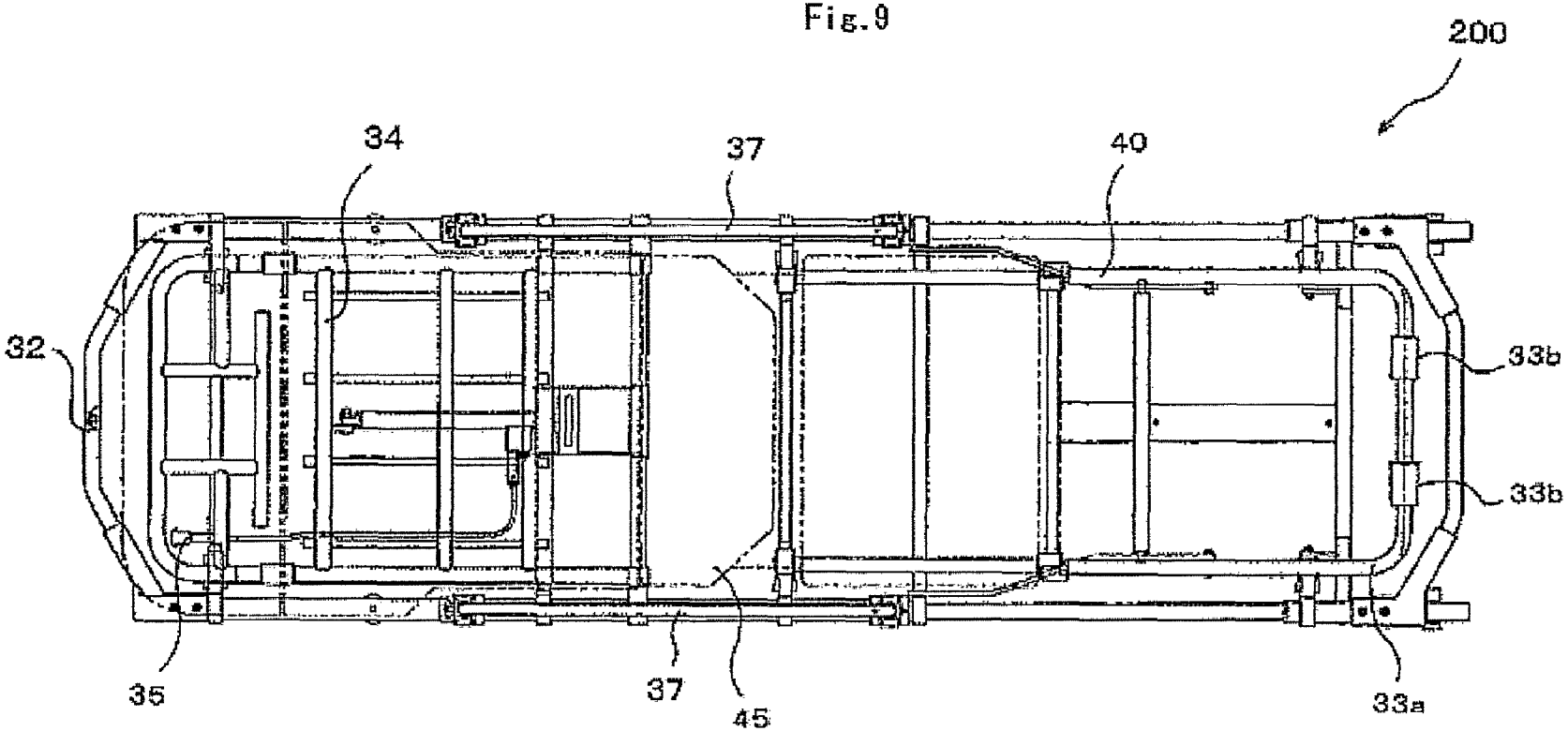
FIG. 9 is a top view of a litter.

FIG. 9 shows the top surface of the litter 200. On the top surface of the litter 200, there is used a mat 45 on which a waterproof sheet containing an elastic cushioning material is stretched. On the head side of litter, the fitting part 32 that fits in the fitting groove 14 of the stretcher is mounted. Further, the lever 33 is provided under the back surface on the head side to raise the backrest of the litter 200. In a middle part of the litter 200, openable shielding plates 37 are installed on both sides of the litter to hold the patient stably.

Figure 10:
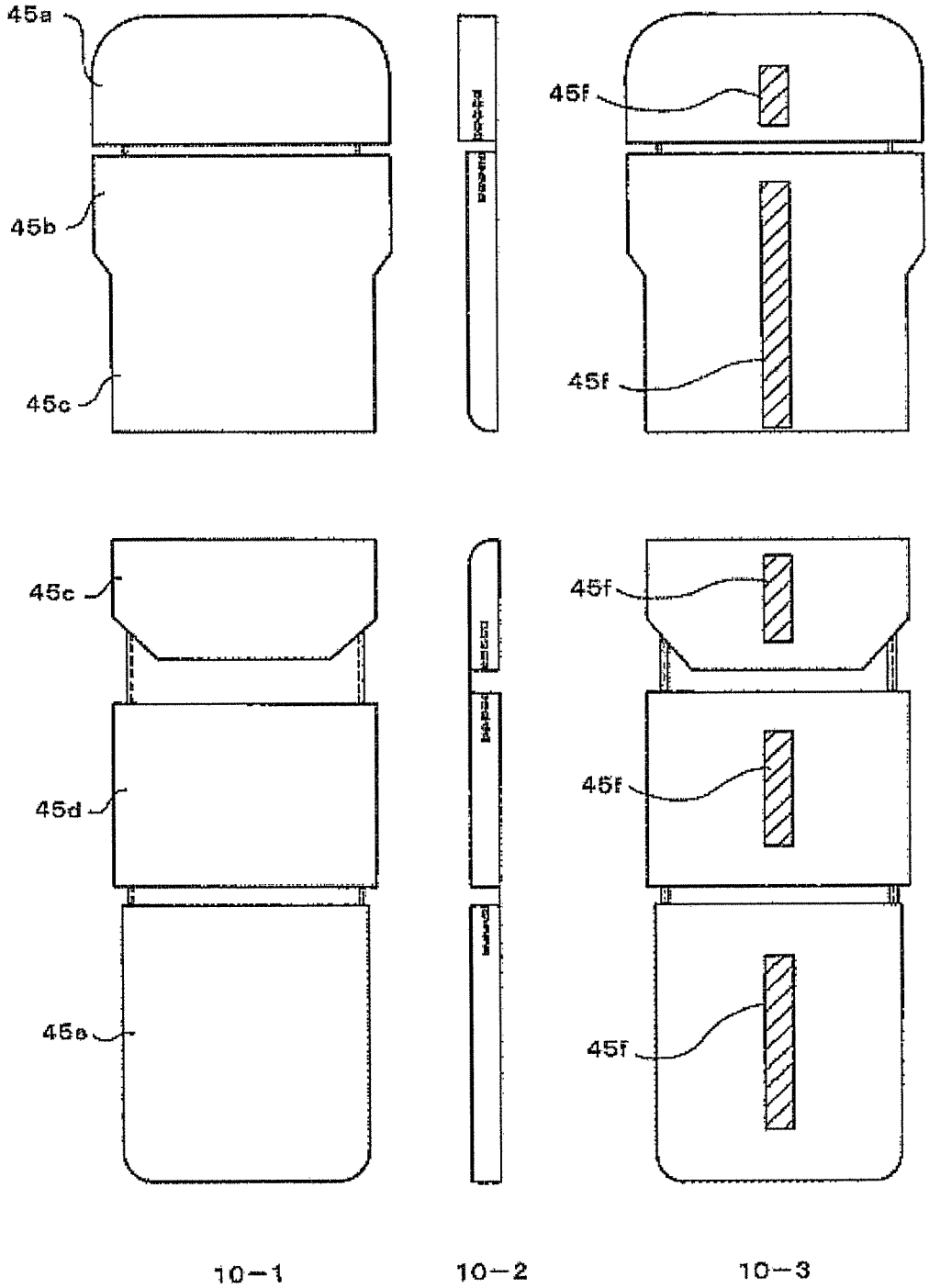
FIG. 10 is a top view and a back view of a mat laid on a litter.

FIG. 10 shows the shape of the mat which is mounted on the frames on both sides of the litter and on which a waterproof sheet containing an elastic cushioning material is stretched. The mat mounted on the litter in accordance with the present invention has a shape such that a shoulder part 45*b* is wider than a trunk part 45*c* as shown in a top view of the mat 45 of FIG. 10-1. By making the shoulder part 45*b* wider than the trunk part 45*c*, a shape is formed such that a cramped feeling is not given to the patient accommodated on the litter, and also medical treatment such as drip-feeding and medical examination can be performed easily. FIG. 10-2 is a side view of the mat, and FIG. 10-3 is a back view of the mat. As shown in the back view, the mat is mounted on the litter frames by hook and loop fasteners 45*f*.

Figure 11:
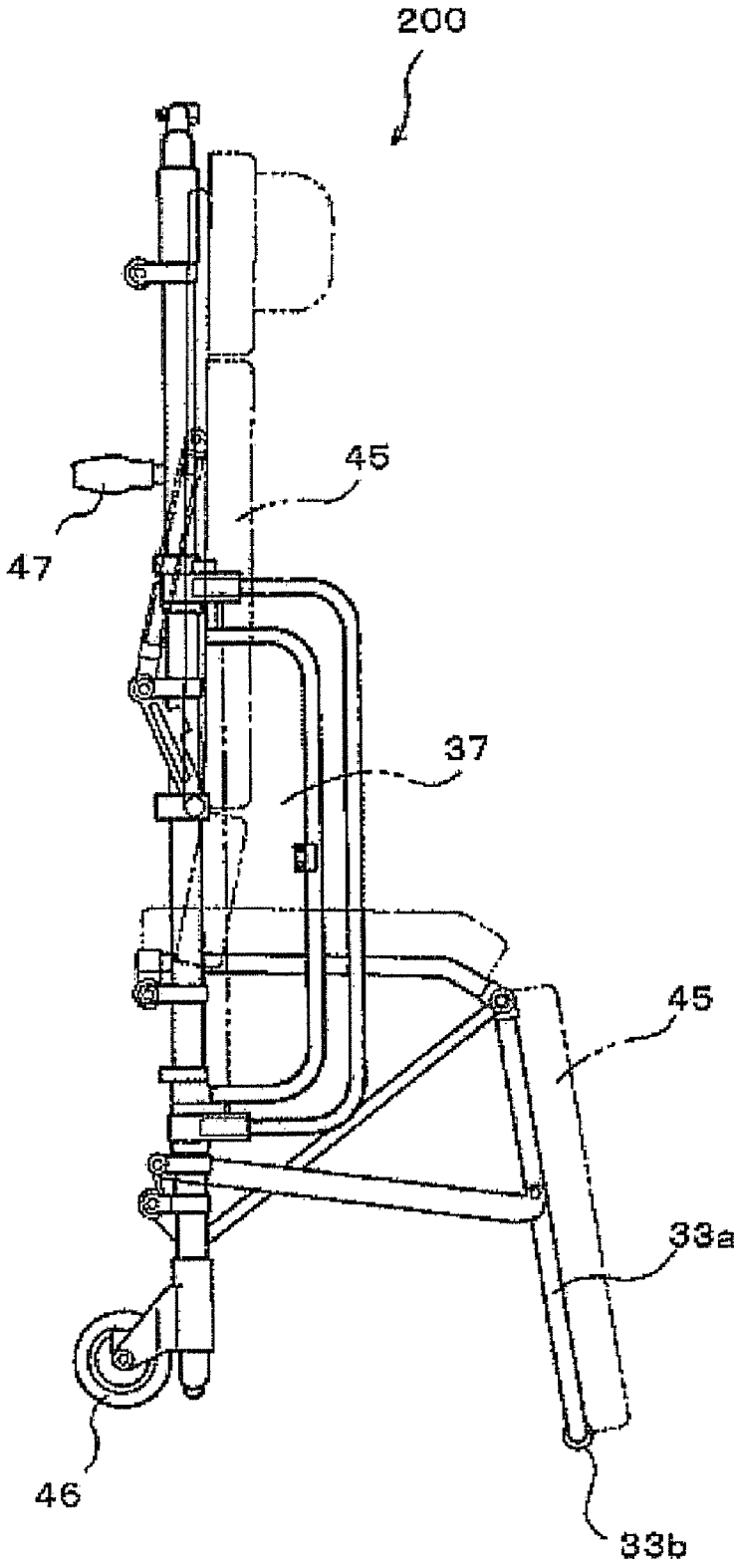
FIG. 11 is a side view of a litter in a chair state.

The litter used to be placed on the stretcher in accordance with the present invention can be erected as shown in FIG. 11 and can be used as a chair shape. In the case where the litter is moved by one person, the litter caster 46 installed at the end part of the litter frame is brought down to the rear while gripping a gripping part 47, and the patient is carried in a slightly laid-down state by using the litter casters 46. As cushioning members 33*b* at the time when the litter is made in the chair state, an elastic synthetic resin or rubber is mounted on a front frame 33*a*. By mounting the cushioning members 33*b*, an effect is achieved that the front frame 33*a* does not come into contact strongly with the floor surface and hence a shock is not given to the patient when the litter is erected after the litter on which the patient rides has been carried. In addition, an effect can be achieved that the frame etc. are not damaged. Further, by making the cushioning members 33*b* detachable, the cushioning members 33*b* can be replaced when being worn.

Figure 12:
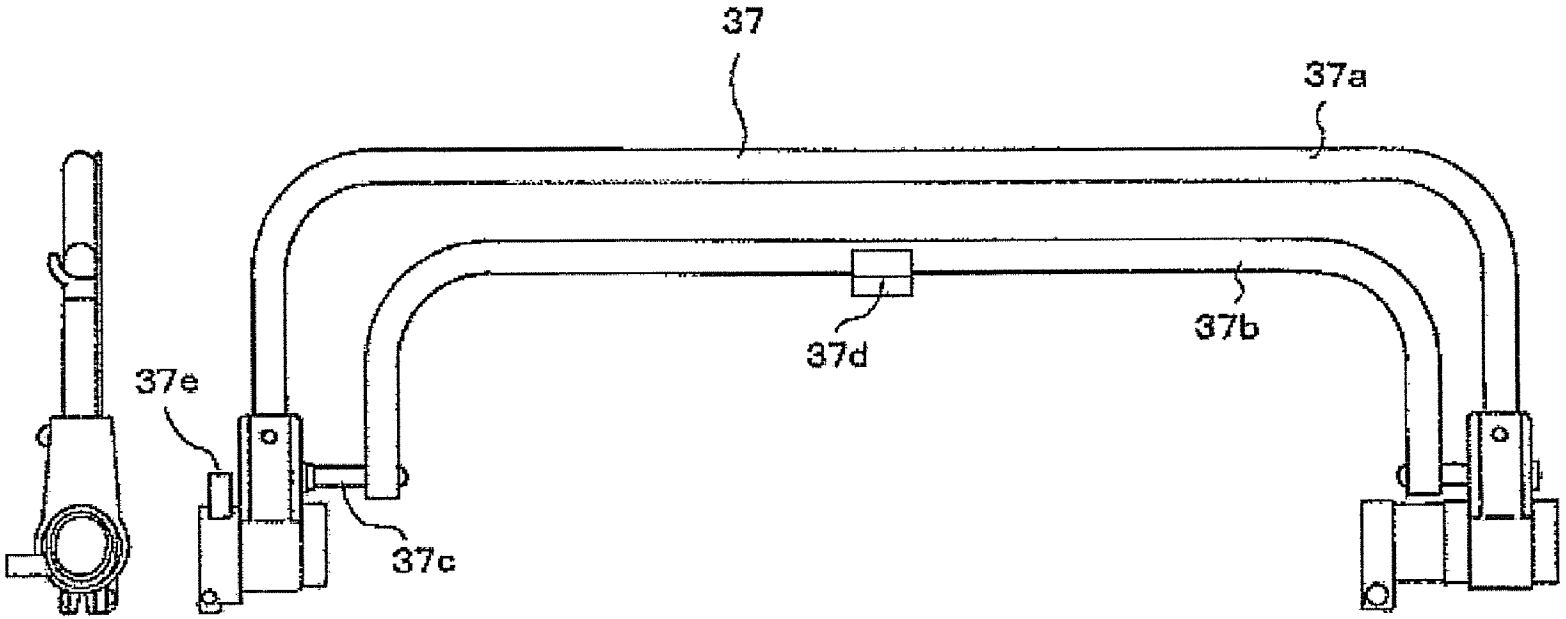
FIG. 12 is a side view of an openable shielding plate of a litter.

As shown in FIG. 12, each of the shielding plates 37, 37 installed on both sides of the litter 200 is made up of two frames of an outside frame 37*a* and an inside frame 37*b*, and has the same shape at the right and left. On the outside frame 37*a*, a lightweight and strong board made of a plastic, aluminum, etc. is stretched. The inside frame 37*b* is supported by a support part 37*d*, which is fixed to the board so as not to fall, in a state of being turnable to the right and left. One end of the inside frame 37*b* is connected to a locking pin 37*c* for opening and closing the shielding plate 37. When the inside frame 37*b* is pulled in one direction of right or left, the pin 37*c* is removed, by which the shielding plate can be opened or closed.

Figure 25:
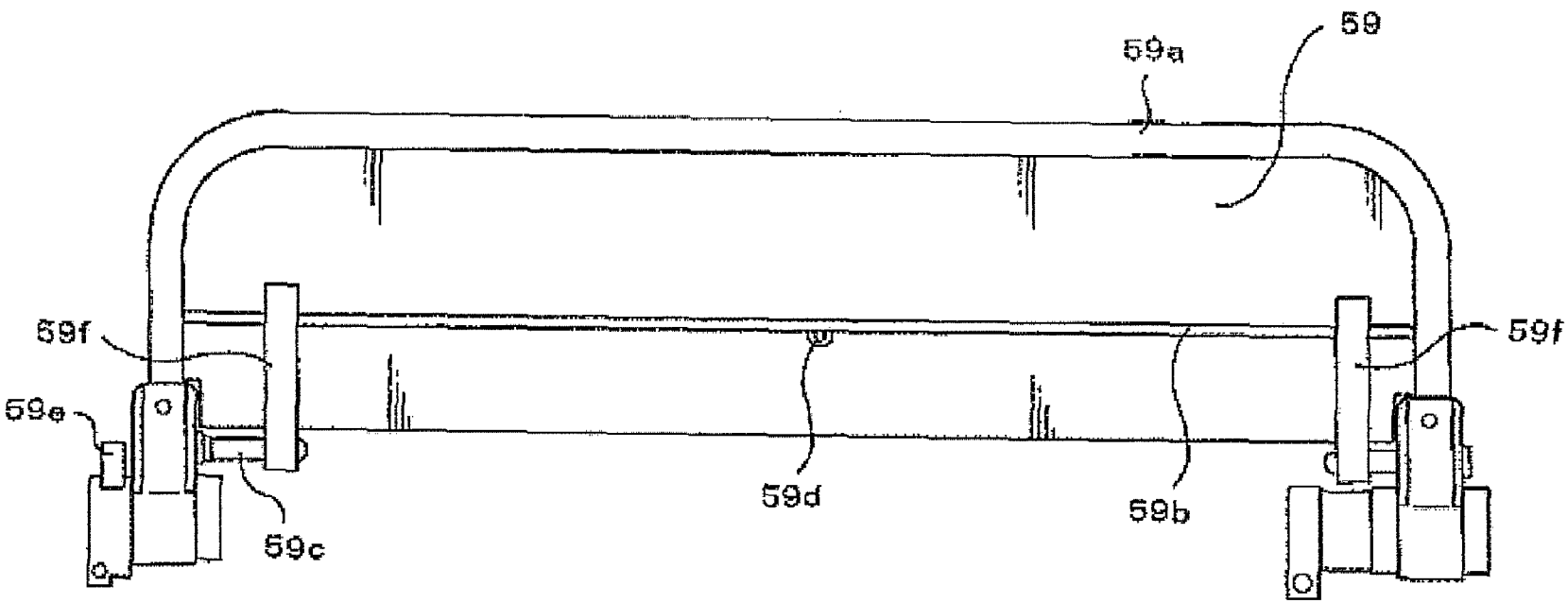
FIG. 25 is a side view of a conventional openable shielding plate of a litter.

The method for locking the conventional shielding plate 59 has been such that, as shown in FIG. 25, when only the right or left vertical part 59*f* is pulled to the right or left, the shielding plate 59 is unlocked. The portion that is gripped when the conventional shielding plate is unlocked is only the vertical part 59*f* that is small and limited, so that the unlocking operation sometimes takes much time in an emergency. In the method for unlocking the shielding plate in accordance with the present invention, since the inside frame 37*b* is connected as shown in FIG. 12, when any of three locations of the right, left, and upper parts of the inside frame 37*b* is gripped and pulled to one side, the pin 37*c* is removed from a locking hole 37*e*, so that the shielding plate is unlocked and brought down. In the case where the shielding plate becomes a hindrance, for example, when an acute patient is put on or down from the litter 200, or when the acute patient laid on the litter is examined or put on a drip, the place to be gripped need not be looked for. When a near place in the right, left, or upper part of the inside frame 37*b* is gripped and pulled, the shielding plate 37 is unlocked, so that the shielding plate can be kept in a brought-down state.

Figure 13:
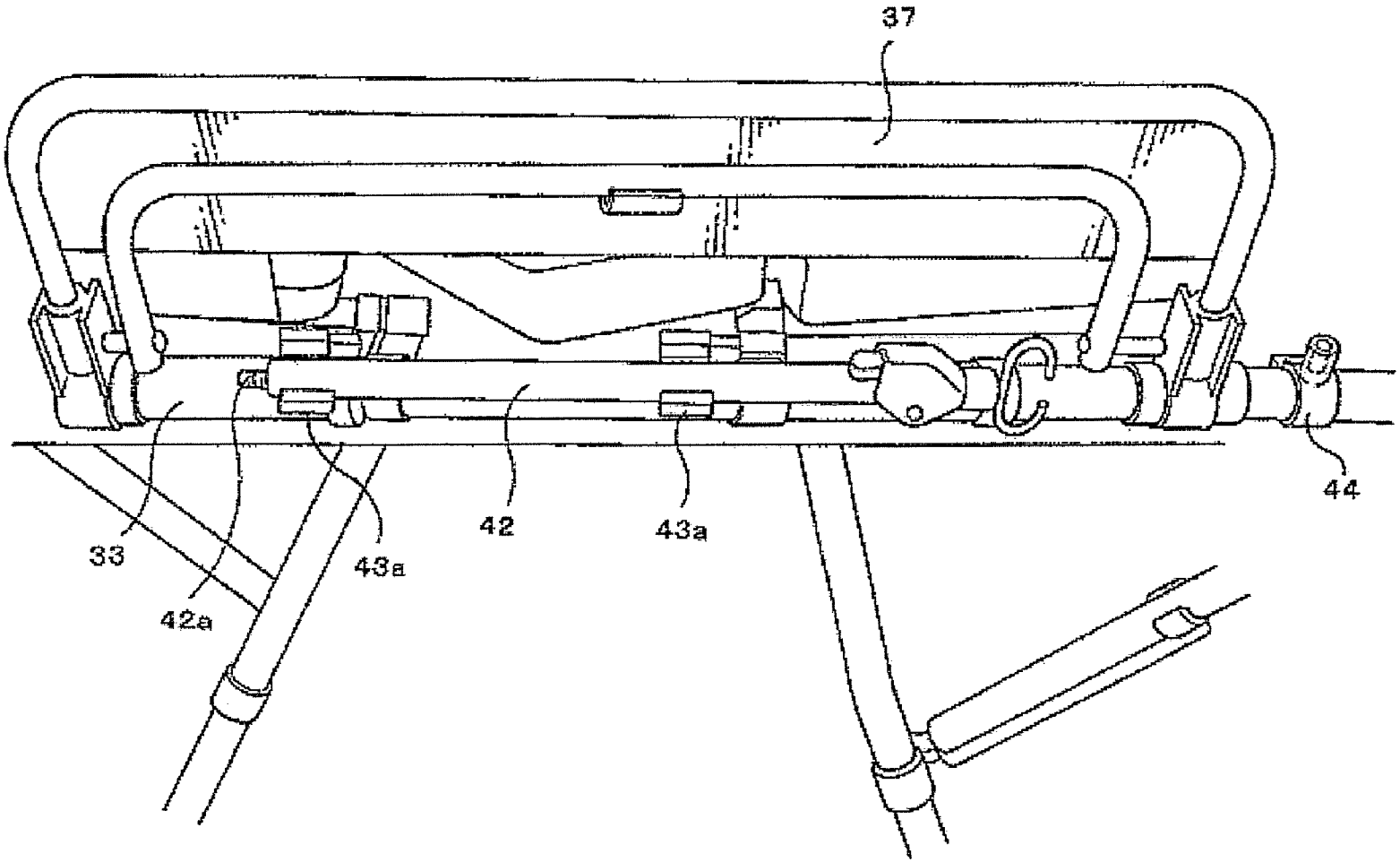
FIG. 13 is a perspective view of a portion in which a hanger for hanging a drip-feeding bottle or bag is mounted on a litter.

FIG. 13 shows a state in which a hanger 42 for hanging a drip-feeding bottle or bag is mounted on a supporting member 43 having a holding part 43*a* above a litter frame 33, the hanger 42 for hanging a drip-feeding bottle or bag, which is mounted with a bolt 42*a* at the end in the lower part of the hanger for hanging a drip-feeding bottle or bag, is hooked on the holding part 43*a*, and a connecting member 44 having a nut 44*a* is mounted on the outside of the shielding plate 37 of the litter.

Figure 14:
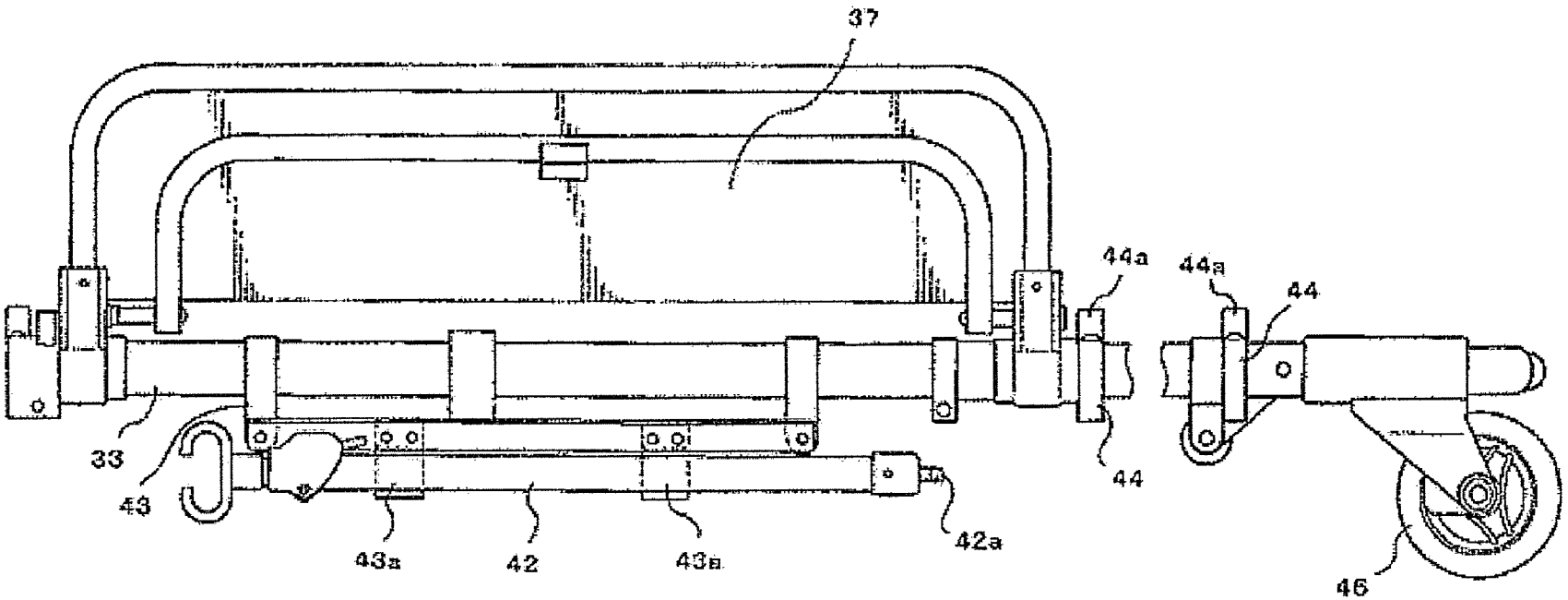
FIG. 14 is a side view of a portion in which a hanger for hanging a drip-feeding bottle or bag is mounted on a litter.

FIG. 14 shows a state in which the hanger 42 for hanging a drip-feeding bottle or bag is mounted on the supporting member 43 having the holding part 43*a* under the litter frame 33, the hanger 42 for hanging a drip-feeding bottle or bag, which is mounted with the bolt 42*a* at the end in the lower part of the hanger for hanging a drip-feeding bottle or bag, is hooked on the holding part 43*a*, and the connecting member 44 having the nut 44*a* can be mounted on the outside of the shielding plate 37 of the litter as shown in FIG. 14-1, or in an end part of the litter as shown in FIG. 14-2. Further, the position at which the connecting member 44 having the nut 44*a* is mounted to erect the hanger for hanging a drip-feeding bottle or bag can be changed to a position at which the drip-feeding can be performed easily as described above. Alternately, a plurality of connecting members 44 can be mounted around the litter to easily perform first-aid lifesaving work.

Figure 15:
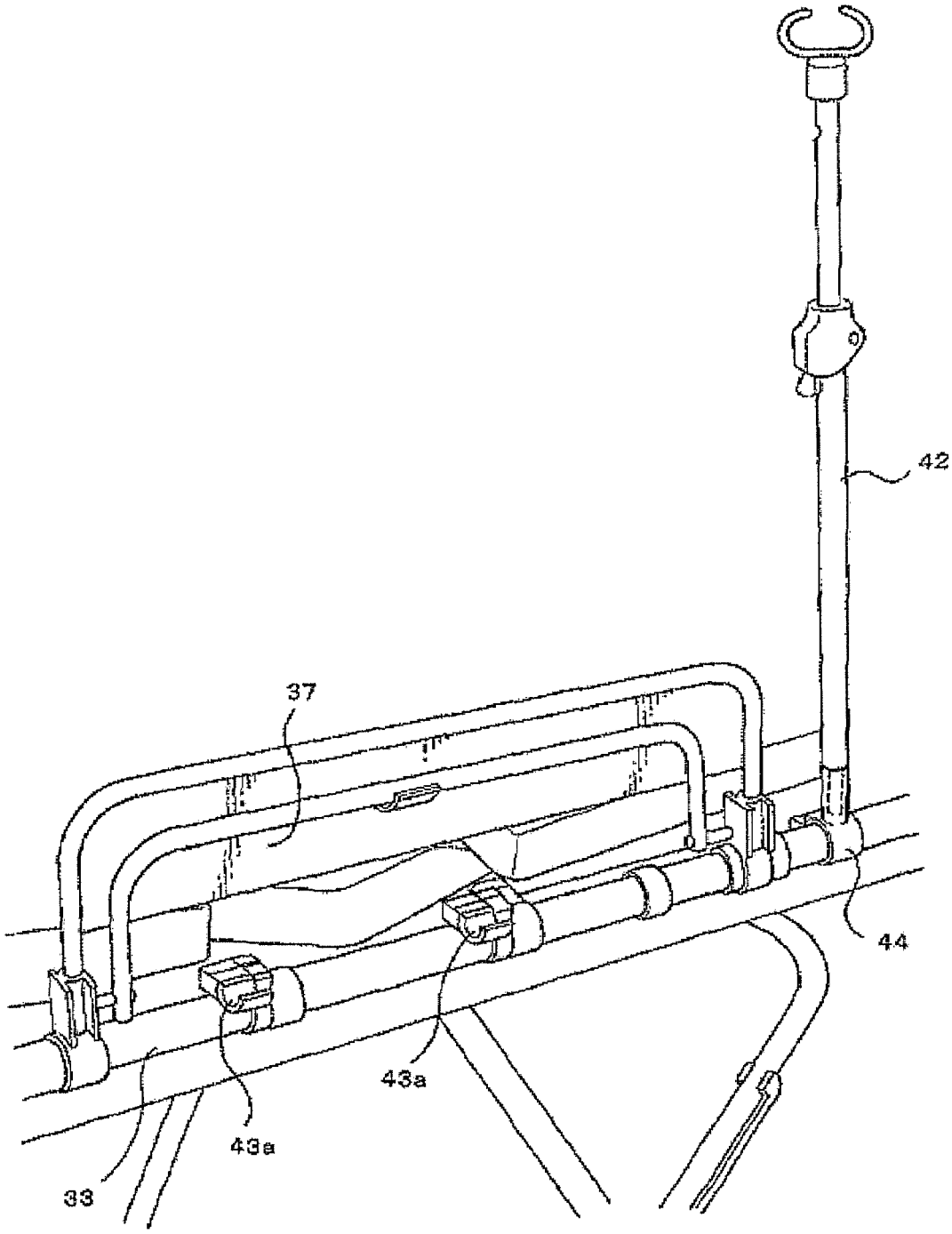
FIG. 15 is a perspective view of a portion in which a hanger for hanging a drip-feeding bottle or bag is erected on a litter.

As shown in FIG. 15, in the case where the hanger 42 for hanging a drip-feeding bottle or bag is needed, a bolt 42*a* at the end in the lower part of the hanger 42 for hanging a drip-feeding bottle or bag is threadedly engaged with the connecting member 44 having the nut 44*a*, by which the hanger 42 for hanging a drip-feeding bottle or bag is used. By mounting the hanger 42 for hanging a drip-feeding bottle or bag on the supporting member 43 installed on the litter frame 33 in this manner, an effect can be achieved that the hanger 42 for hanging a drip-feeding bottle or bag does not occupy a good deal of space, and can be used immediately as necessary.

Figure 16:
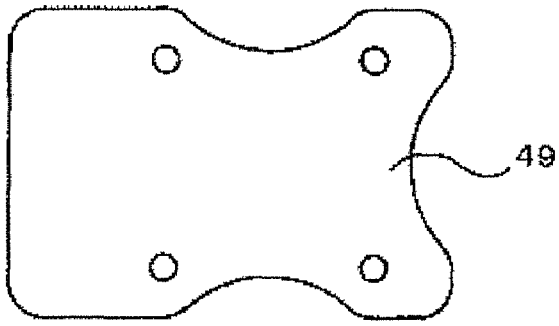
FIG. 16 is a top view and a side view of a front hook.
Figure 16:
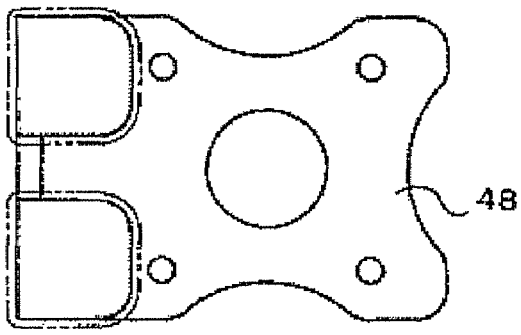
Figure 16:
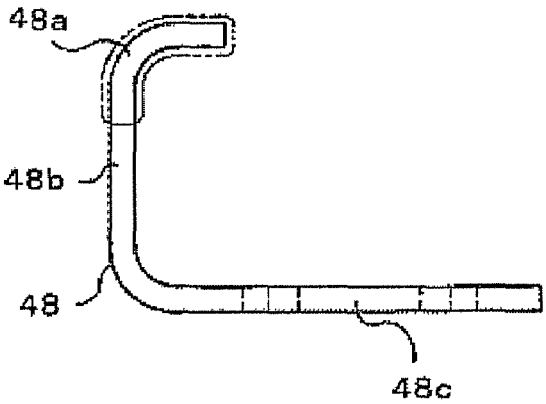
Figure 16:
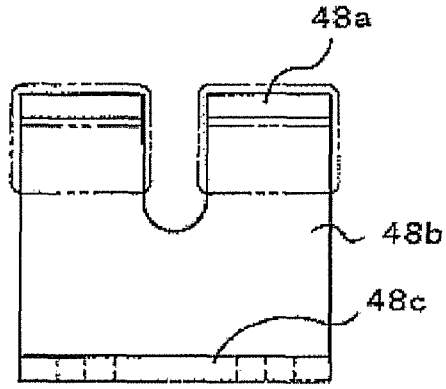

FIG. 16 shows a front hook 48 constituting a fixture, which is an element for fixing the front part of the placed stretcher by being mounted on the front floor surface of the patient carrying automobile. FIG. 16-1 shows a front plate 49 that is a plate laid under the front hook 48 when the front hook 48 is mounted on the front floor surface of the patient carrying automobile. FIG. 16-2 is a top view of the front hook 48. In a tip end portion 48*a* of the front hook 48, a rubber or a soft synthetic resin is affixed or a paint etc. are applied as a cushioning member to absorb a shock caused when the stretcher frame makes contact and also to prevent the frame etc. from being damaged. The affixing of cushioning member or painting may be adjusted to a position at which the frame makes contact. FIG. 16-3 is a front view of the front hook 48. FIG. 16-4 is a side view of the front hook 48. The cushioning member may be affixed or applied down to a rising part 48*b* of the front hook 48.

Figure 17:
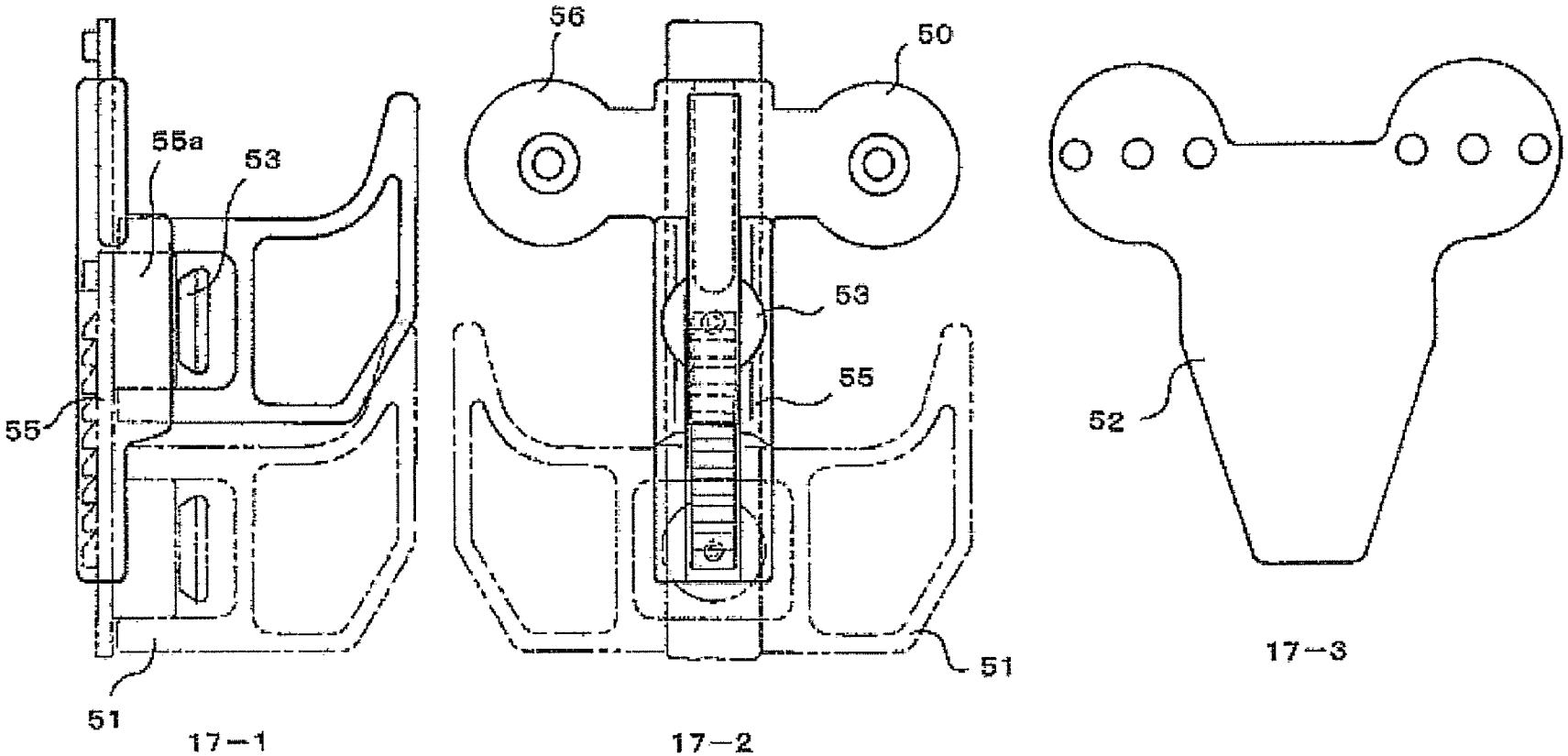
FIG. 17 is a top view and a side view of a lock plate.

FIG. 17 shows a lock plate 50 having a lock piece 51 that is installed on the rear cargo bed of the patient carrying automobile and engages with a lock supporter mounted in the rear part of the stretcher. The lock plate 50 constitutes a fixture 300 of stretcher for fixing the stretcher together with the front hook. As shown in FIG. 17-1, the lock plate 50 includes the lock piece 51, a rail 55 having many irregularities, a pin 54 engaging with a concave portion of the irregularities, and a lever 53 for operating the detachment of the pin. In the central part of the rail 55, a support part 55*a* for supporting the lock piece 51 is present. The lock piece 51 is erected vertically by being supported by the support part 55*a* in the central part of the rail 55, and is fixed by the pin 54. As shown in a top view of FIG. 17-2, when the lock piece 51 is removed from the support part 55*a* by pulling out the pin 54, the lock piece 51 can be brought down to either side of the right and left (dotted line portion). In the case where the stretcher is placed on the cargo bed of the patient carrying automobile, the stretcher is placed in the state in which the lock piece 51 is brought down. When the stretcher is placed, the stretcher is pushed from the rear of the cargo bed of the patient carrying automobile to the front thereof, and the front part of the stretcher is brought into contact with the front hook mounted on the front floor surface of the cargo bed. Then, the lock piece 51 is raised and pushed on the rail 55, by which the lock piece 51 is engaged with the lock supporter mounted in the rear part of the stretcher, and thereby the stretcher is fixed to the cargo bed of the patient carrying automobile. FIG. 17-3 shows an under plate 52 that is laid between the lock plate 50 and the floor surface of the cargo bed when the lock plate 50 is fixedly installed on the floor surface of cargo bed of the patient carrying automobile.

Figure 18:
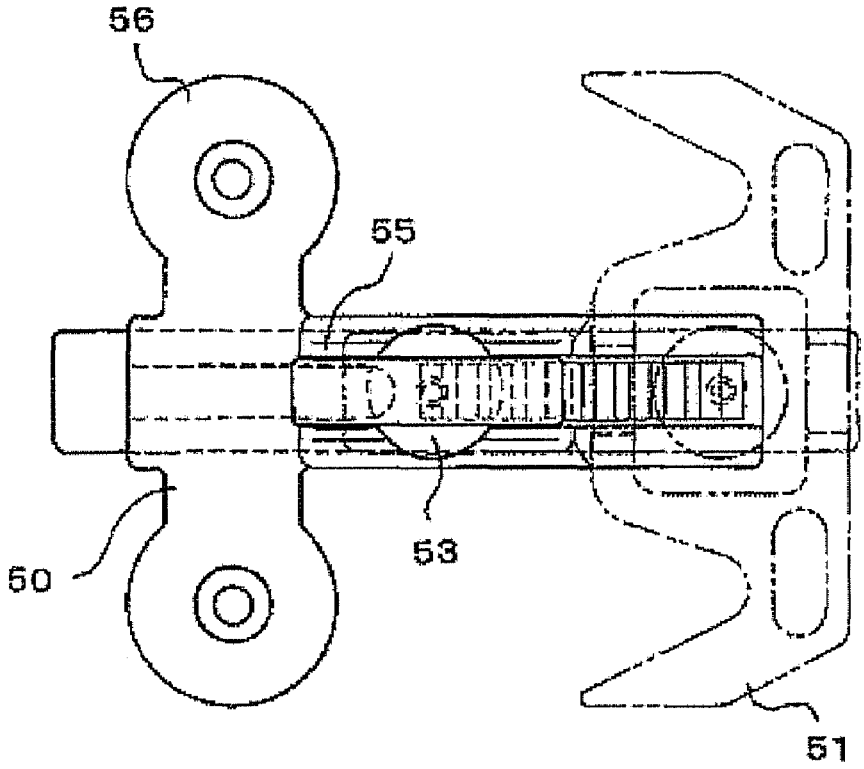
FIG. 18 is a top view and a side view of a lock lever and a lock pin.
Figure 18:
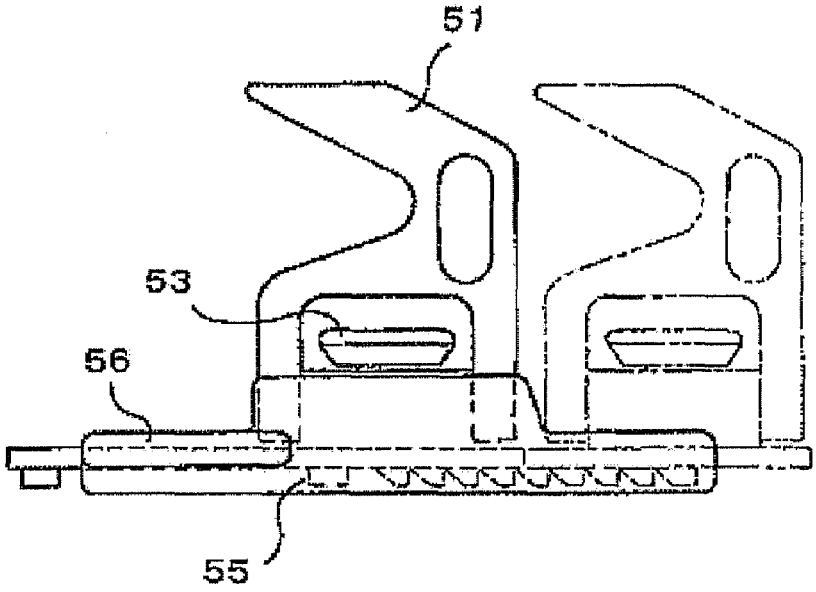

FIG. 18 shows a lock plate 50 having a different shape of the part that is mounted on the rear cargo bed of the ambulance and engages with the lock supporter mounted in the rear part of the stretcher. The lock plate 50 has the lock piece 51 having a different shape shown in FIG. 18. FIG. 18-1 is a top view of the lock plate 50, showing a state in which the lock piece 51 is brought down. The lock piece 51 can be brought down to either side of the right and left on the rail 55. Since the lock piece 51 of the lock plate 50 becomes a hindrance when the stretcher is put down from or put on the cargo bed of the patient carrying automobile, the stretcher is put on or down in the state in which the lock piece 51 is brought down. FIG. 18-2 shows that the lock piece 51 can move from the end (dotted line portion) of the rail 55 to the position of the support part 55*a*. The lock piece 51 indicated by a solid line indicates that the lock piece 51 has moved to the support part 55*a* located at a position of being engaged with the lock supporter mounted in the rear part of the stretcher.

Figure 19:
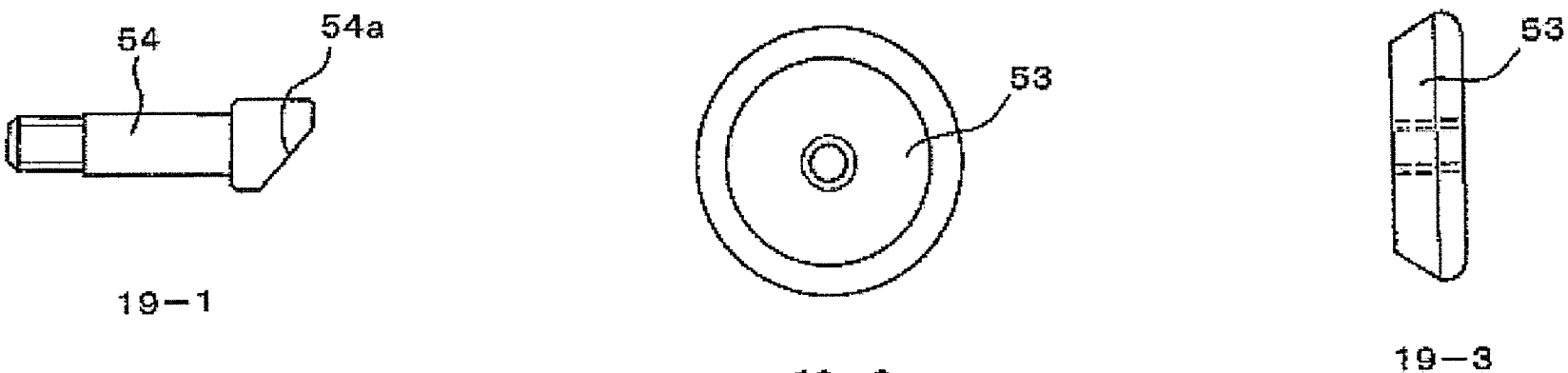
FIG. 19 is a top view and a side view of a lock plate having a different shape.

FIG. 19 shows the pin 54 engaging with a concave portion 55*b* of many irregularities provided on the rail 55 under the lock piece 51 of the stretcher fixture and the lever 53 that operates the detachment of the pin. As shown in a side view of the pin 54 of FIG. 19-1, a slant surface 54*a* is provided on one side of the tip end part of the pin so that the pin 54 is easy to engage with the concave portion 55*b* on the rail and difficult to remove. FIG. 19-2 is a top view of the lever 53 that operates the detachment of the pin 54. FIG. 19-3 is a side view of the lever 53. Between the pin 54 and the lever 53, a spring (not shown) is urged, so that the pin 54 is engaged with the concave portion 55*b* to fix the lock piece 51 in the normal state, and when the lever 53 is pulled up, the pin 54 is released. The lock piece 51 is released in the state in which the lever 53 is brought up, and the lock piece 51 can move longitudinally on the rail 55.

Figure 20:
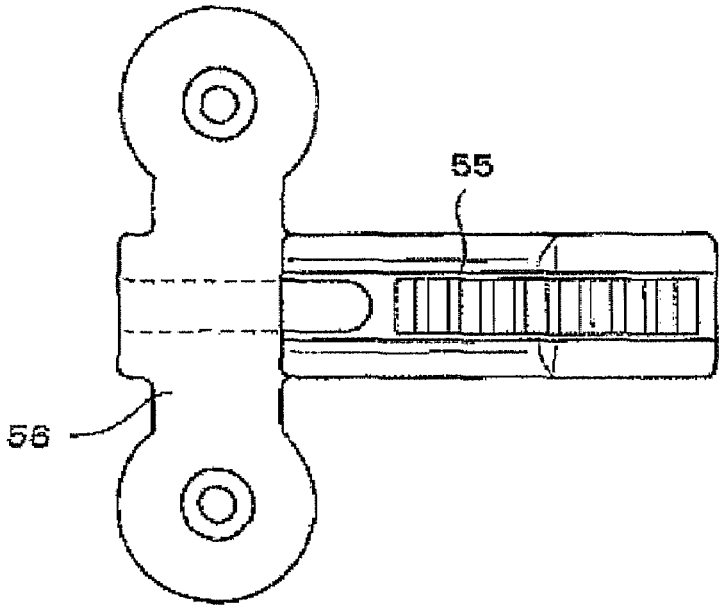
FIG. 20 is a top view and a side view of a rail for a lock plate.
Figure 20:
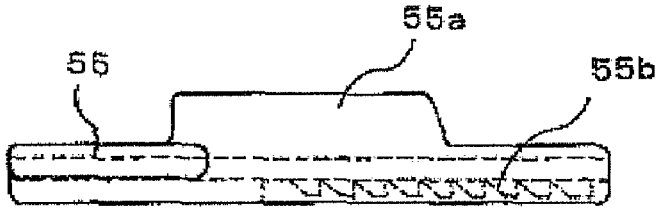
Figure 20:
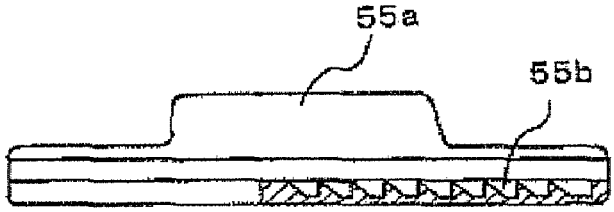

FIG. 20 is a top view and a side view of the rail 55 that is located under the lock piece 51 and has many irregularities. FIG. 20-1 is a top view of a fixing part 56 for fixing the lock plate 50 on the floor surface of cargo bed of the patient carrying automobile and the rail 55 that is connected to the fixing part 56 and has many irregularities. As shown in FIG. 20-2, many irregularities have a support part 55*a* for supporting the lock piece 51 in the middle part of the rail 55, and can keep the lock piece 51 in an erected state in the range of the support part 55*a* provided on both sides in the middle part of the rail 55. The lock piece 51 is moved in the range of the support part 55*a* and fixed by being brought into contact with the lock supporter of stretcher. As shown in FIG. 20-3, a convex portion 55*c* of the continuous irregularities has a mountain shape such as to rise substantially at right angles on the side facing to the front hook and gently fall on the rear side thereof. Thereby, the lock piece 51 of the lock plate 50 can be pushed toward the front of the patient carrying automobile, and when the lock piece 51 is moved to the rear or when it is released, the lock piece 51 is pulled to the rear with one hand while raising the lever 53, by which the lock piece 51 can be separated from the support part 55*a* and brought down to the right or left.

Figure 21:
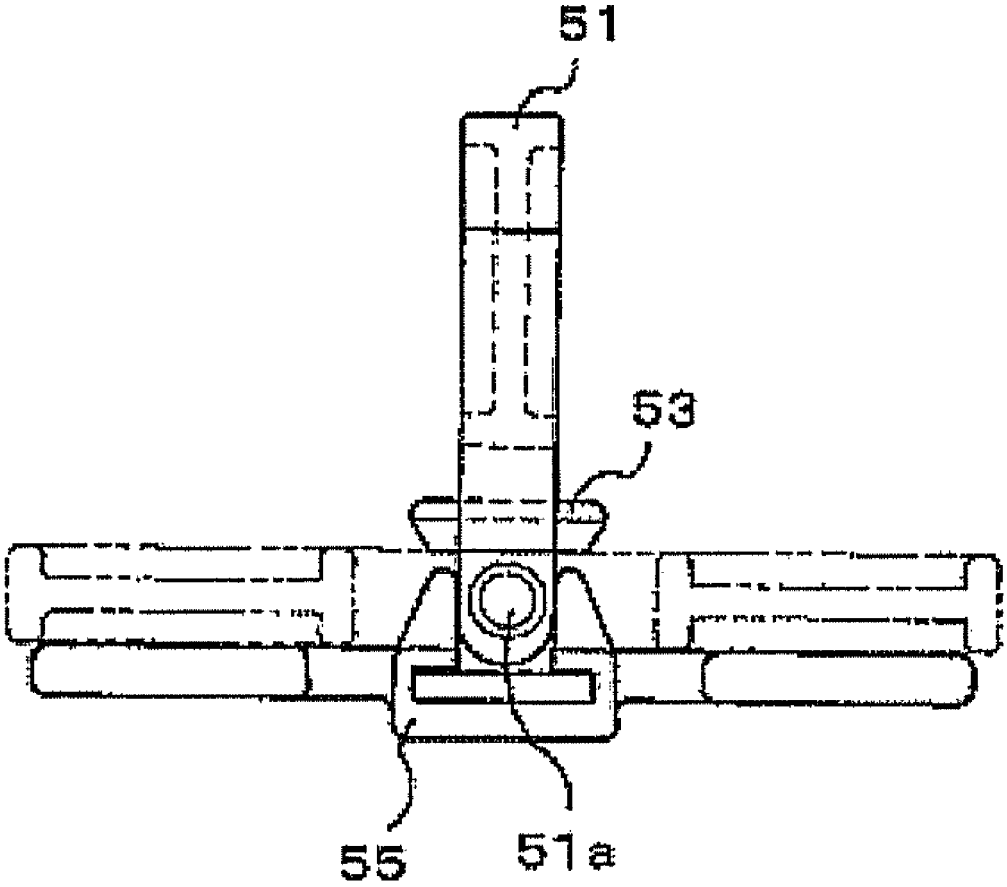
FIG. 21 is a front view of a lock plate.

FIG. 21 shows the shape of the lock piece 51 of the lock plate 50 in an erected state, viewed from the rear. Both sides of the lock piece 51 are pivotally supported by a pivotally supporting part 51*a* with the lever 53 being held in the lower end part of the lock piece, and the lock piece 51 turns to the right or left around the pivotally supporting part 51*a* when the support part 55*a* is released. The lock piece 51 is moved longitudinally while raising the lock piece 51 and the lever 53 in the lower end part of the lock piece 51, by which the lock piece 51 is engaged with the lock supporter of stretcher at the position of the support part 55*a* or is separated from the support part 55*a*. By bringing the lock piece 51 down to the right or left, the stretcher is put on or put down from the cargo bed of the patient carrying automobile.

Figure 22:
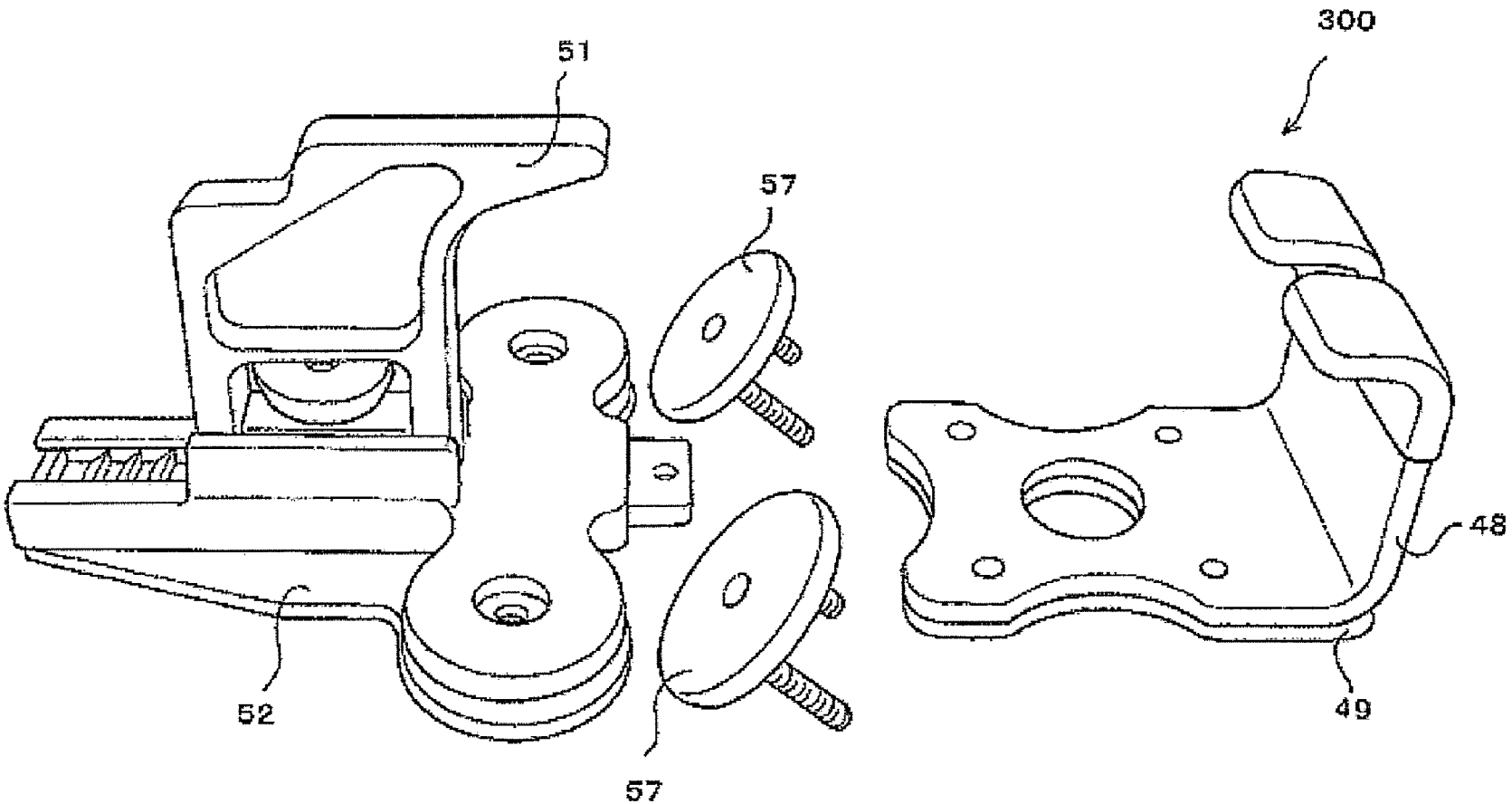
FIG. 22 is a perspective view of a lock plate and a front hook.

FIG. 22 shows the lock plate 50, anchor plates 57 for fixing the lock plate 53, and the front hook 48, which are components of the stretcher fixture 300 in accordance with the present invention. The lock plate 50 fixes the under plate 52 on the cargo bed of the patient carrying automobile by using the anchor plates 57, and fixes the lock plate 50 from the upside.

Figure 23:
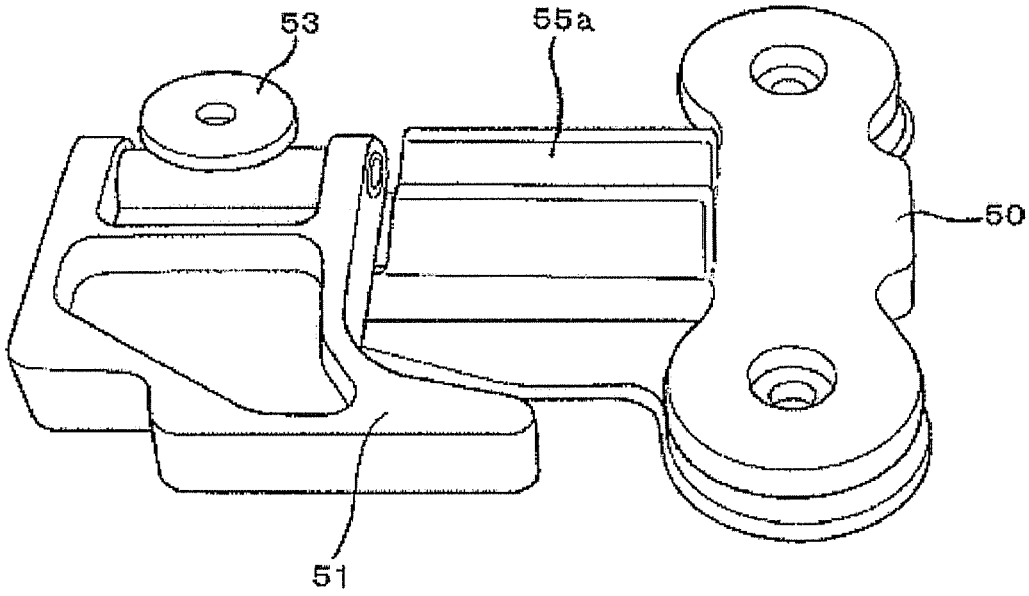
FIG. 23 is a perspective view showing a state in which a lock plate is brought down.

FIG. 23 shows a state in which the lock piece 51 of the lock plate 50 is brought down. When the lock piece 51 is separated from the support part 55*a* on the rail 55 and the lock piece is brought down, the lever 53 installed between the lock piece 51 and the rail 55 appears.

Figure 24:
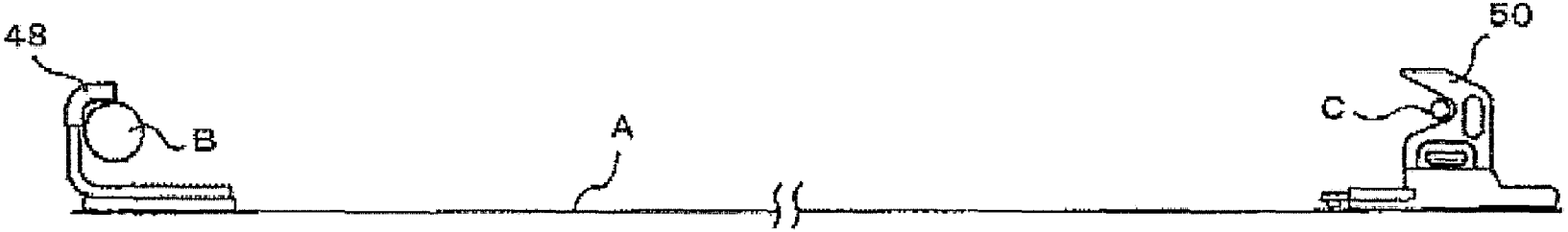

FIG. 24 shows a state in which the front hook 48 is provided in the front part of the cargo bed A of the patient carrying automobile and the lock plate 50 is mounted in the rear part thereof. The frame B of the stretcher comes into contact with the front hook 48 in the front part of the cargo bed of the patient carrying automobile, and the lock supporter C of the stretcher comes into contact with the lock plate 50, by which the stretcher is fixed on the cargo bed of the patient carrying automobile with the stretcher being held between the front hook 48 and the lock plate 50 from the front and rear.

The invention claimed is:

1. A stretcher comprising an upper frame for placing a litter thereon, having casters on a front leg and a rear leg; a constant load spring serving as a slide mechanism for changing the position of the upper frame vertically; a pin lock mechanism for fixing the upper frame having been moved vertically at an arbitrary position; a trapezoidal concave-shaped fitting groove for fixing the head side of a litter to the front end part of the upper frame; and a C-shaped hook for fixing the foot side of the litter to the rear end part of the upper frame, characterized in that a vertically and longitudinally adjustable lock supporter engaging with a lock piece for fixing the stretcher installed on the cargo bed of an ambulance or the like is provided in the rear part of the stretcher, and the pin lock mechanism is mounted with an emergency lever.

2. A litter for being placed on the stretcher according to claim 1, which has a trapezoidal convex-shaped fitting part having a slant surface to be engaged with a fitting groove provided in the front end part of the stretcher, characterized in that a wheel is provided at one end of a frame on both sides of the litter; an openable shielding plate is installed on the frame on both sides of the litter; and the shielding plate can be unlocked and opened/closed by gripping any of three directions of the right, left, and upper parts of an inside frame of the shielding plate.

3. The litter according to claim 2, further comprising a supporting member and a nut, wherein the supporting member supports a hanger having a member for hanging a drip-feeding bag at one end thereof and a bolt to be secured with the nut to the litter frame at the other end thereof.

4. The litter according to claim 2, which can also be used as a chair, when a cushioning material is provided on the front frame, and the mat secured to the side frames of the litter is wider at the shoulder portion thereof than at the waist portion thereof.

5. The stretcher fixture according to claim 1, wherein the pin lock mechanism is further characterized in that the front lever of the stretcher and the lock pin of the front leg frame are connected with a wire and rear lever is connected to the front leg aiding frame and the rear leg aiding frame with a wire, that the lock pin of the front leg frame is released when the front lever is pulled and the lock pin of the front leg aiding frame and the rear leg aiding frame is released when the rear lever is pulled, locking being entirely unlocked when the front and rear pins are pulled, and that the front and rear legs are fixed at desired positions when the front and rear levers are released.

* * * * *